US010730310B2

(12) United States Patent
Tanabe

(10) Patent No.: US 10,730,310 B2
(45) Date of Patent: Aug. 4, 2020

(54) LIQUID EJECTION APPARATUS IN WHICH NOTIFICATION ON REMAINING AMOUNT OF LIQUID IN LIQUID CHAMBER IS SUITABLY PERFORMED BASED ON CALCULATED FIRST AND SECOND VOLUMES

(71) Applicant: BROTHER KOGYO KABUSHIKI KAISHA, Nagoya-shi, Aichi-ken (JP)

(72) Inventor: Yuma Tanabe, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/297,816

(22) Filed: Mar. 11, 2019

(65) Prior Publication Data

US 2019/0299642 A1 Oct. 3, 2019

(30) Foreign Application Priority Data

Mar. 30, 2018 (JP) ..... 2018-067949

(51) Int. Cl.
*B41J 2/175* (2006.01)

(52) U.S. Cl.
CPC .. *B41J 2/17566* (2013.01); *B41J 2002/17569* (2013.01)

(58) Field of Classification Search
USPC ..... 347/7, 85
See application file for complete search history.

(56) References Cited

U.S. PATENT DOCUMENTS 6,155,664 A * 12/2000 Cook ..... B41J 2/17509 347/19
6,431,672 B1 * 8/2002 Ardito ..... B41J 2/17513 347/7
2004/0061748 A1 * 4/2004 Kuwabara ..... B41J 2/17509 347/85
2005/0057586 A1 * 3/2005 Brenner ..... B41J 2/17566 347/7
2009/0201351 A1 8/2009 Shimizu et al.

FOREIGN PATENT DOCUMENTS

JP 2008-238792 A 10/2008

* cited by examiner

*Primary Examiner* — Lam S Nguyen
(74) *Attorney, Agent, or Firm* — Merchant & Gould P.C.

(57) ABSTRACT

A liquid ejection apparatus includes: a cartridge including a first storage chamber storing liquid; a tank including a second storage chamber storing liquid; at least one nozzle; a detecting portion detecting whether a level of the liquid in the second storage chamber becomes equal to a prescribed position; a notifying portion; and a controller configured to perform: when the level of the liquid in the second storage chamber becomes equal to the prescribed position, calculating first and second volumes; and when the second volume is greater than the first volume, notify that the level of the liquid in the second storage chamber becomes equal to the prescribed position. The first volume is an amount of the liquid in the first storage chamber above the level of the second storage chamber at a time when the level of the liquid in the second storage chamber becomes equal to the prescribed position.

6 Claims, 13 Drawing Sheets

LIQUID EJECTION APPARATUS IN WHICH NOTIFICATION ON REMAINING AMOUNT OF LIQUID IN LIQUID CHAMBER IS SUITABLY PERFORMED BASED ON CALCULATED FIRST AND SECOND VOLUMES

CROSS REFERENCE TO RELATED APPLICATION

This application claims priority from Japanese Patent Application No. 2018-067949 filed Mar. 30, 2018. The entire content of the priority application is incorporated herein by reference.

TECHNICAL FIELD

The present disclosure relates to a liquid ejection apparatus in which liquid flows from a cartridge to a tank due to hydraulic head difference.

BACKGROUND

For example, Japanese Patent Application Publication No. 2008-238792 discloses a system in which liquid is supplied from a cartridge to a tank due to hydraulic head pressure, and then supplied from the tank to a head (consuming portion) configured to consume liquid. In the system disclosed in Japanese Patent Application Publication No. 2008-238792, a sensor configured to detect displacement of a sensor arm provided in the cartridge is used to determine a remaining amount of the liquid in the cartridge.

In the meantime, in another system in which liquid is supplied to a tank due to hydraulic head pressure, in order to detect a remaining amount of liquid in the cartridge, a remaining amount of the liquid in the corresponding tank is detected using a sensor rather than directly detecting the remaining amount of the liquid in the cartridge by providing a sensor arm in the cartridge.

SUMMARY

In the latter system described above, when a sensor detects that the remaining amount of the liquid in the tank decreases, the system notifies a user based on the detection that the remaining amount of the liquid in the cartridge is lowered to a prescribed amount, for example, no ink that can be supplied to the tank is remaining in the cartridge. However, in such system, the level of the liquid stored in the tank may temporarily differ from the level of the liquid stored in the cartridge. Thereafter, the level of the liquid in the tank becomes the same as that of the liquid in the cartridge. That is, a certain period of time is required until the level of the liquid stored in the cartridge and the level of the liquid stored in the tank becomes the same as each other.

In such a case, before the certain period of time has elapsed, i.e., in a state where the level of the liquid in the tank differs from the level of the liquid in the cartridge, the sensor may detect that the remaining amount of the liquid in the tank has lowered. In other words, the sensor detects that the remaining amount of the liquid in the tank has decreased even when a sufficient amount of the liquid is remaining in the cartridge, or the liquid remaining in the cartridge is to be supplied to the tank due to hydraulic head difference. Accordingly, the system notifies the user, based on the detection result obtained by the sensor, that no ink that can be supplied to the tank is remaining in the cartridge. As a result, the system erroneously notifies the user that the remaining amount of the ink has lowered based on the inappropriate detection result.

In view of the foregoing, it is an object of the disclosure to provide a liquid ejection apparatus capable of decreasing a probability of erroneous notification that the remaining amount of ink has decreased.

In order to attain the above and other objects, according to one aspect, the disclosure provides a liquid ejection apparatus including: a cartridge; a tank to which the cartridge is connectable; at least one nozzle; a detecting portion; a memory; a notifying portion; and a controller. The cartridge includes: a first storage chamber configured to store liquid therein; and a first air communicating portion allowing the first storage chamber to communicate with an atmosphere. The tank includes: a second storage chamber configured to store the liquid therein; an inlet port through which the liquid stored in the first storage chamber of the cartridge connected to the tank is introduced into the second storage chamber; an outlet port through which the liquid stored in the second storage chamber flows out; and a second air communicating portion allowing the second storage chamber to communicate with the atmosphere. The at least one nozzle is configured to eject the liquid flowing out from the second storage chamber through the outlet port. The detecting portion is configured to detect whether a level of the liquid stored in the second storage chamber becomes equal to or lower than a prescribed position. The memory stores therein a first liquid amount and a second liquid amount. The first liquid amount is an amount of the liquid stored in the first storage chamber. The second liquid amount is an amount of the liquid stored in the second storage chamber. The controller is configured to perform: in response to receiving a command to consume the liquid, (a) controlling the at least one nozzle to eject the liquid at a speed; (b) determining, while performing the (a) controlling, whether the detecting portion detects that the level of the liquid stored in the second storage chamber becomes equal to or lower than the prescribed position; in response to the (b) determining determining that the detecting portion detects that the level of the liquid stored in the second storage chamber becomes equal to or lower than the prescribed position, (c) calculating a first volume and a second volume, the first volume being an amount of the liquid stored in the first storage chamber above the level of the second storage chamber at a time when the detecting portion detects that the level of the liquid stored in the second storage chamber becomes equal to or lower than the prescribed position, the first volume being calculated based on the first liquid amount, the second liquid amount, and a third volume, the third volume being an amount of the liquid ejected by the at least one nozzle since start of the (a) controlling until the detecting portion detects that the level of the liquid stored in the second storage chamber becomes equal to or lower than the prescribed position, the second volume being an amount of the liquid ejected by the at least one nozzle since the detecting portion detects that the level of the liquid stored in the second storage chamber becomes equal to or lower than the prescribed position until completion of the (a) controlling; (d) determining whether the second volume is greater than the first volume; and in response to the (d) determining determining that the second volume is greater than the first volume, (e) controlling the notifying portion to notify that the level of the liquid stored in the second storage chamber becomes equal to or lower than the prescribed position.

According to another aspect, the disclosure provides a liquid ejection apparatus including: a cartridge; a tank to which the cartridge is connectable; at least one nozzle; a detecting portion; a memory; a notifying portion; and a controller. The cartridge includes: a first storage chamber configured to store liquid therein; and a first air communicating portion allowing the first storage chamber to communicate with an atmosphere. The tank includes: a second storage chamber configured to store the liquid therein; an inlet port through which the liquid stored in the first storage chamber of the cartridge connected to the tank is introduced into the second storage chamber; an outlet port through which the liquid stored in the second storage chamber flows out; and a second air communicating portion allowing the second storage chamber to communicate with the atmosphere. The at least one nozzle is configured to eject the liquid flowing out from the second storage chamber through the outlet port. The detecting portion is configured to detect whether a level of the liquid stored in the first storage chamber becomes equal to or lower than a prescribed position. The memory stores therein a first liquid amount and a second liquid amount. The first liquid amount is an amount of the liquid stored in the first storage chamber. The second liquid amount is an amount of the liquid stored in the second storage chamber. The controller is configured to perform: in response to receiving a command to consume the liquid, (a) controlling the at least one nozzle to eject the liquid at a speed; (b) determining, while performing the (a) controlling, whether the detecting portion detects that the level of the liquid stored in the first storage chamber becomes equal to or lower than the prescribed position; in response to the (b) determining determining that the detecting portion detects that the level of the liquid stored in the first storage chamber becomes equal to or lower than the prescribed position, (c) calculating a first volume and a second volume, the first volume being an amount of the liquid stored in the second storage chamber above the level of the first storage chamber at a time when the detecting portion detects that the level of the liquid stored in the first storage chamber becomes equal to or lower than the prescribed position, the first volume being calculated based on the first liquid amount, the second liquid amount, and a third volume, the third volume being an amount of the liquid ejected by the at least one nozzle since start of the (a) controlling until the detecting portion detects that the level of the liquid stored in the first storage chamber becomes equal to or lower than the prescribed position, the second volume being an amount of the liquid ejected by the at least one nozzle since the detecting portion detects that the level of the liquid stored in the first storage chamber becomes equal to or lower than the prescribed position until completion of the (a) controlling; (d) determining whether the second volume is greater than the first volume; and in response to the (d) determining determining that the second volume is greater than the first volume, (e) controlling the notifying portion to notify that the level of the liquid stored in the first storage chamber becomes equal to or lower than the prescribed position.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

First Embodiment

Hereinafter, a multifunction peripheral 10 as an example of a liquid ejection apparatus according to a first embodiment of the present disclosure will be described with reference to FIGS. 1 through 10B. It would be apparent that the embodiment(s) described below is merely an example of the disclosure and may be modified in many ways without departing from the scope of the disclosure.

Figure 1A:
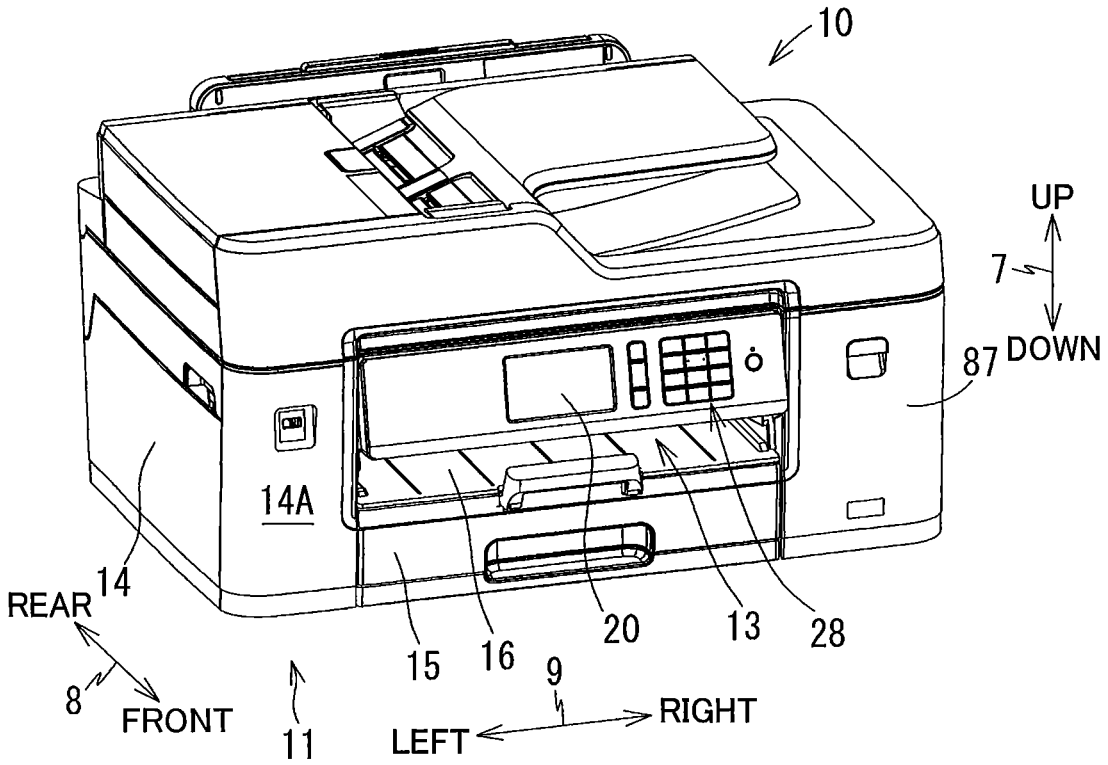
FIG. 1A is a perspective view of a multifunction peripheral 10 according to a first embodiment of the present disclosure, and illustrating a closed position of a cover 87 of the multifunction peripheral 10.

In the following description, up, down, front, rear, left, and right directions related to the multifunction peripheral 10 will be referred to assuming that the multifunction peripheral 10 is disposed on a horizontal plane so as to be operable, as illustrated in FIG. 1A. Note that this posture of the multifunction peripheral 10 illustrated in FIG. 1A will also be referred to as an "operable posture". Specifically, an up-down direction 7 of the multifunction peripheral 10 is defined based on the operable posture of the multifunction peripheral 10. A front-rear direction 8 is defined assuming that a surface of the multifunction peripheral 10 formed with an opening 13 is a front surface of the multifunction peripheral 10 in the operable posture. A left-right direction 9 is defined based on an assumption that the multifunction peripheral 10 in the operable posture is viewed from its front surface.

In the present embodiment, in the operable posture of the multifunction peripheral 10, the up-down direction 7 is parallel to a vertical direction, and the front-rear direction 8 and the left-right direction 9 are parallel to a horizontal direction. Further, the front-rear direction 8 and the left-right direction 9 are orthogonal to each other.

<Overall Configuration of Multifunction Peripheral 10>

Figure 1B:
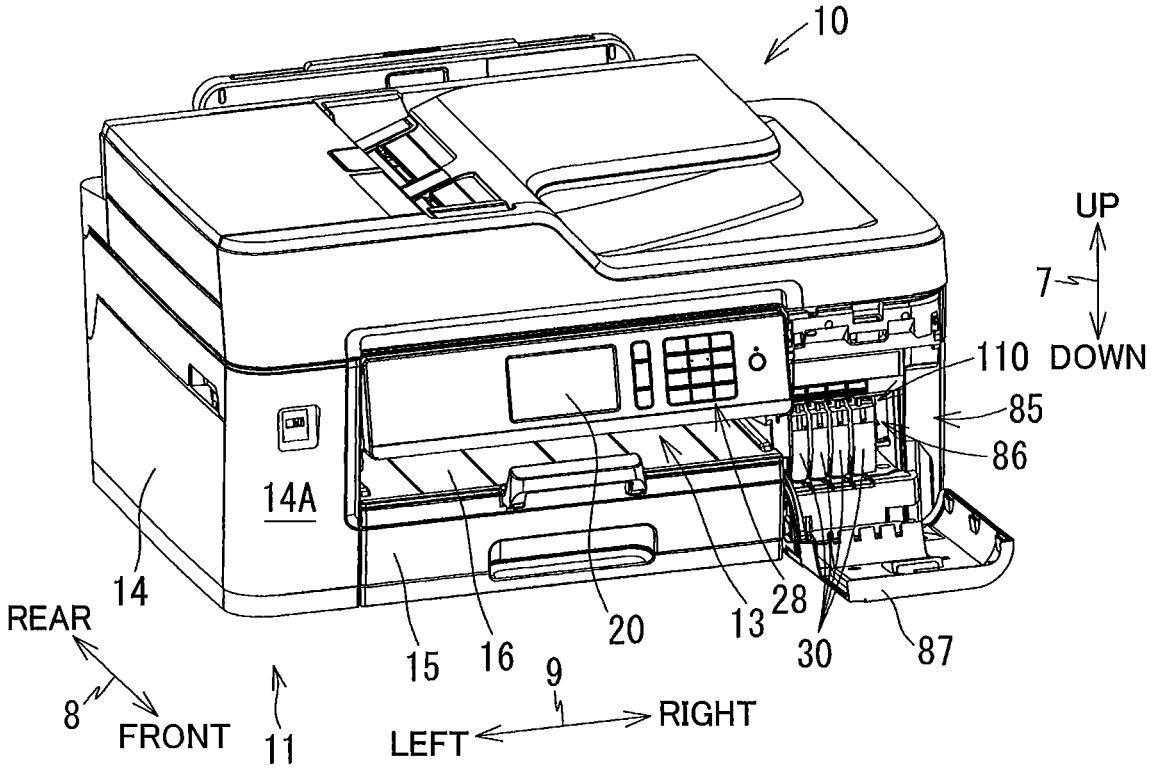
FIG. 1B is a perspective view of the multifunction peripheral 10 according to the first embodiment, and illustrating an open position of the cover 87.

As illustrated in FIGS. 1A and 1B, the multifunction peripheral 10 has a lower portion in which a printer portion 11 is provided. The printer portion 11 is configured to record an image on a sheet of paper 12 (see FIG. 2) based on an inkjet recording method. The multifunction peripheral 10 may have various functions such as a facsimile function, a scanning function, and a copying function. The printer portion 11 includes a casing 14 having a substantially rectangular parallelepiped shape.

The casing 14 has a front surface 14A on which a display 20 (an example of a notifying portion) and an operating portion 28 are provided. The display 20 is a liquid crystal display or an organic electroluminescence (EL) display, for example. The display 20 has a display surface configured to display various kinds of information thereon. The operating portion 28 is configured to output an operation signal in accordance with a user's operation to a controller 130 that controls various operations on the multifunction peripheral 10. The operating portion 28 may include push buttons, for example. Alternatively, if the display 20 has a touch sensor function, this display 20 having the touch sensor function may serve as the operating portion 28.

Figure 2:
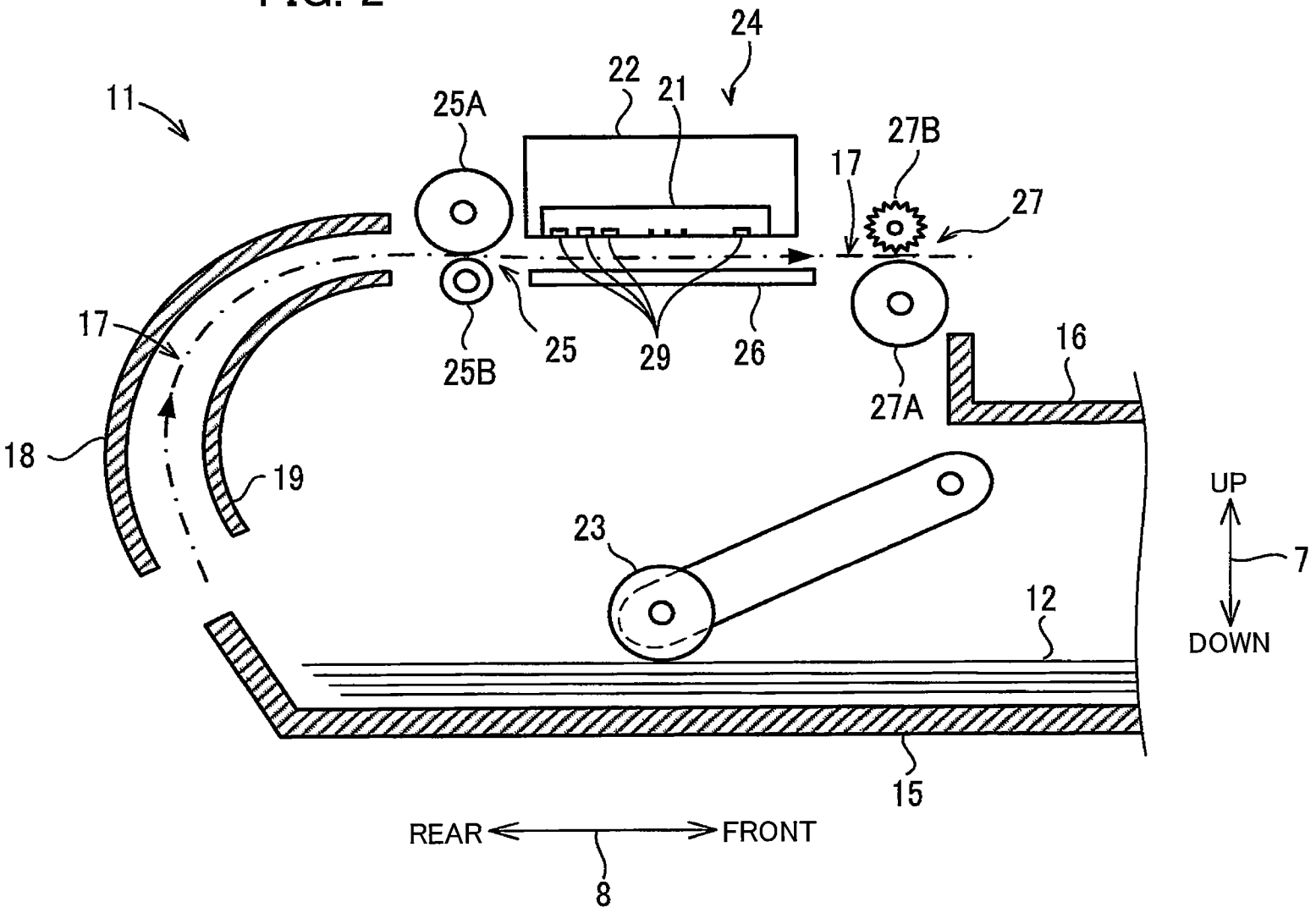
FIG. 2 is a vertical cross-sectional view schematically illustrating an internal configuration of a printer portion 11 of the multifunction peripheral 10 according to the first embodiment.

As illustrated in FIG. 2, within the casing 14, a feed tray 15, a discharge tray 16, a feed roller 23, a conveying roller pair 25, a discharge roller pair 27, a recording portion 24, and a platen 26 are disposed.

<Feed Tray 15, Discharge Tray 16, and Feed Roller 23>

As illustrated in FIGS. 1A and 1B, the front surface 14A is formed with the opening 13 at a generally center portion thereof in the left-right direction 9. The feed tray 15 is inserted into and extracted from the casing 14 through the opening 13 in the front-rear direction 8. The feed tray 15 is configured to support the sheets 12 in a stacked state.

The discharge tray 16 is disposed above the feed tray 15. The discharge tray 16 is configured to support the sheets 12 discharged by the discharge roller pair 27 from the portion between the recording portion 24 and the platen 26. The feed roller 23 is configured to be driven by a motor (not illustrated) so as to feed each of the sheets 12 supported in the feed tray 15 onto a conveying path 17.

<Conveying Path 17>

As illustrated in FIG. 2, the conveying path 17 is a space defined by a guide member 18, a guide member 19, the recording portion 24, the platen 26, and the like. The guide member 18 and the guide member 19 are disposed inside the printer portion 11 and face each other with a predetermined gap therebetween. The recording portion 24 and the platen 26 are also disposed inside the printer portion 11 and face each other with a predetermined gap therebetween.

The conveying path 17 extends rearward from a rear end portion of the feed tray 15, and then, makes a U-turn frontward while extending upward, passes through a portion facing the recording portion 24, and reaches the discharge tray 16. A conveying direction in which each of the sheets 12 is conveyed in the conveying path 17 is indicated by a dashed-dotted arrow in FIG. 2.

<Conveying Roller Pair 25>

The conveying roller pair 25 is disposed in the conveying path 17. The conveying roller pair 25 includes a conveying roller 25A and a pinch roller 25B arranged to oppose each other. The conveying roller 25A is configured to be driven by a motor (not illustrated). The pinch roller 25B is configured to be rotated following rotation of the conveying roller 25A. As the conveying roller 25A and the pinch roller 25B make forward rotation in response to forward rotation of the motor (not illustrated), each of the sheets 12 is nipped between the conveying roller 25A and the pinch roller 25B and is conveyed in the conveying direction.

<Discharge Roller Pair 27>

The discharge roller pair 27 is disposed downstream of the conveying roller pair 25 in the conveying direction in the conveying path 17. The discharge roller pair 27 includes a discharge roller 27A and a spur roller 27B arranged to oppose each other. The discharge roller 27A is configured to be driven by a motor (not illustrated). The spur roller 27B is configured to be rotated following rotation of the discharge roller 27A. As the discharge roller 27A and the spur roller 27B make forward rotation in response to forward rotation of the motor (not illustrated), each of the sheets 12 is nipped between the discharge roller 27A and the spur roller 27B and is conveyed in the conveying direction.

<Recording Portion 24 and Platen 26>

As illustrated in FIG. 2, the recording portion 24 and the platen 26 are disposed at a position between the conveying roller pair 25 and the discharge roller pair 27 in the conveying direction. More specifically, the recording portion 24 and the platen 26 are positioned downstream of the conveying roller pair 25, and positioned upstream of the discharge roller pair 27 in the conveying direction. The recording portion 24 and the platen 26 are arranged to oppose each other in the up-down direction 7.

The recording portion 24 includes a carriage 22 and a recording head 21 mounted on the carriage 22. The carriage 22 is configured to reciprocate in the left-right direction 9 by a driving force transmitted from a motor (not illustrated). A plurality of nozzles 29 are provided at a lower surface of the recording head 21. That is, the recording portion 24 includes at least one nozzle 29. The recording portion 24 is configured to eject ink droplets through the nozzles 29 by driving vibrating elements such as piezoelectric elements.

Ink tubes (not illustrated) and a flexible flat cable (not illustrated) are connected to the carriage 22. The ink tubes connect a cartridge receiving portion 110 (described later, see FIG. 3) and the recording head 21. More specifically, each of the ink tubes is configured to supply ink stored in corresponding ink cartridge 30 attached to the cartridge receiving portion 110 to the recording head 21.

In the present embodiment, four ink cartridges 30 are attachable to the cartridge receiving portion 110. Accordingly, four ink tubes are provided in one-to-one correspondence with the four ink cartridges 30 so that ink of four colors (black, magenta, cyan, and yellow) stored in the respective four ink cartridges 30 can flow through the corresponding ink tubes. These ink tubes are bundled and connected to the carriage 22. The flexible flat cable electrically connects the recording head 21 to the controller 130 (see FIG. 8).

While the controller 130 controls the conveying roller pair 25 to temporarily stop conveyance of the sheet 12 in a state where a portion of the sheet 12 faces the recording head 21, the controller 130 also controls the carriage 22 to move in the left-right direction 9 and the recording head 21 to eject the ink droplets through the nozzles 29. Accordingly, a part of an image is recorded onto the portion of the sheet 12 that faces the recording head 21 (hereinafter referred to as "one pass"). Subsequently, the controller 130 controls the conveying roller pair 25 to convey the sheet 12 such that another portion of the sheet 12 to which another part of the image is to be recorded faces the recording head 21. By alternately repeating the processes described above, an image is fully recorded onto the sheet 12.

<Cover 87>

As illustrated in FIG. 1B, the front surface 14A is formed with an opening 85 at a right end portion thereof. The casing 14 includes a cover 87 pivotally movable between a closed position (a position illustrated in FIG. 1A) closing the opening 85 and an open position (a position illustrated in FIG. 1B) exposing the opening 85. The cover 87 is supported to the casing 14 near the lower edge thereof so as to be pivotally movable about a pivot axis extending in the left-right direction 9. An accommodating space 86 is formed to the rear of the opening 85 in the casing 14 and is in communication with the opening 85. The cartridge receiving portion 110 is disposed within the accommodating space 86.

<Cartridge Receiving Portion 110>

Figure 3:
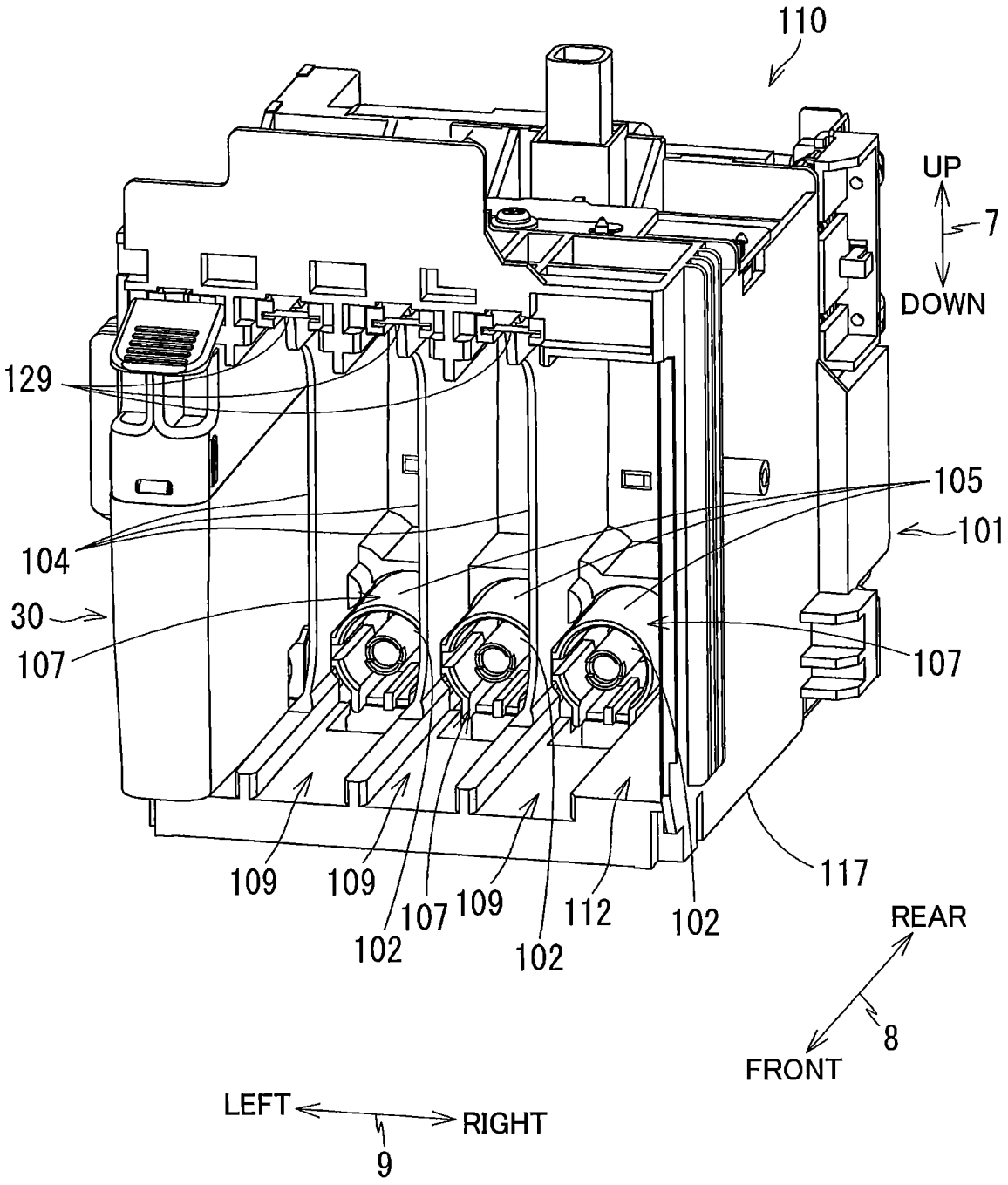
FIG. 3 is a perspective view illustrating an external appearance of a cartridge receiving portion 110 of the multifunction peripheral 10 according to the first embodiment as viewed from a side thereof at which an opening 112 is formed.
Figure 4:
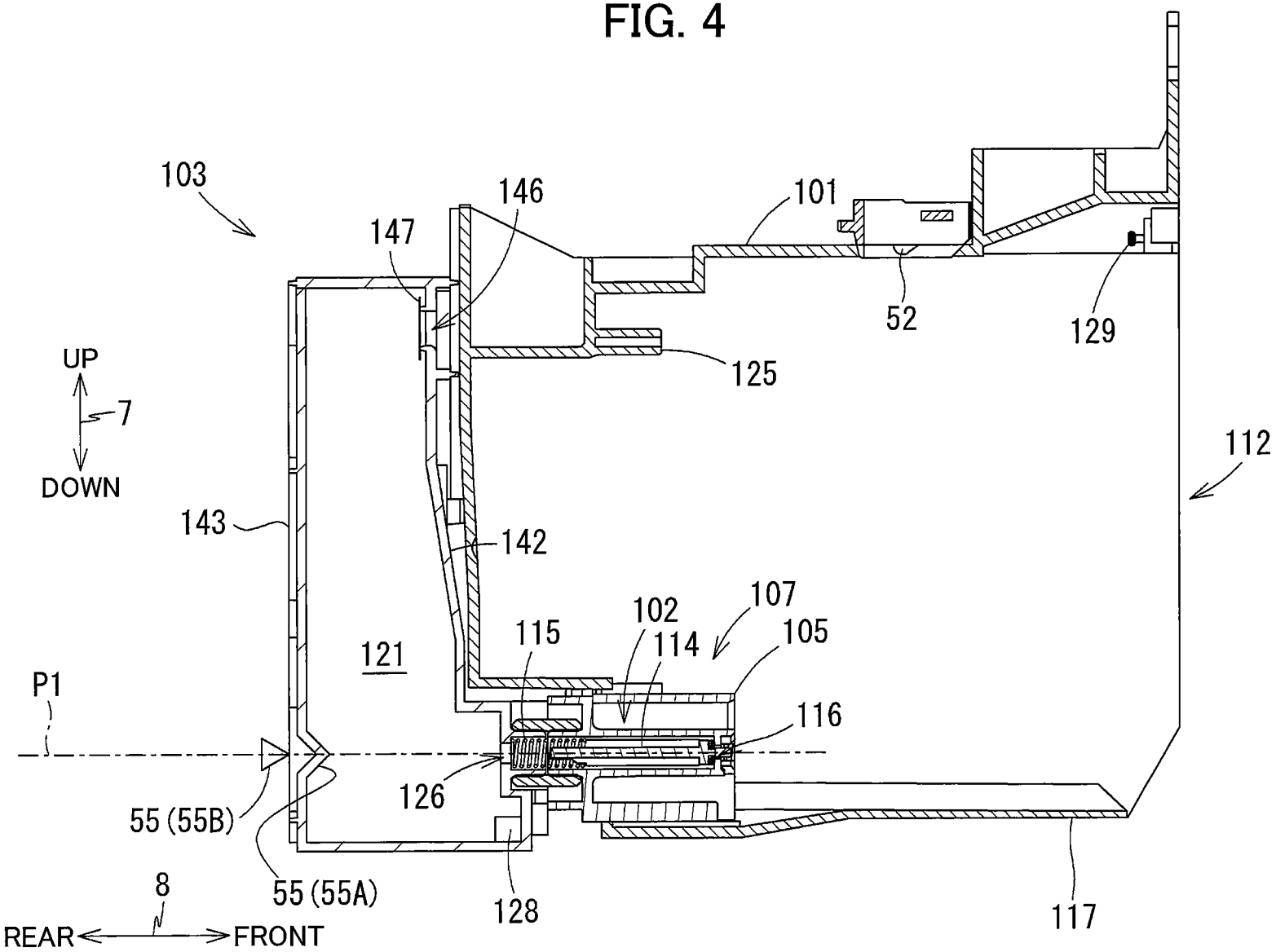
FIG. 4 is a vertical cross-sectional view of the cartridge receiving portion 110 of the multifunction peripheral 10 according to the first embodiment.

As illustrated in FIGS. 3 and 4, the cartridge receiving portion 110 includes a cartridge case 101, contacts 52, rods 125, a locking portion 129, tanks 103, and liquid-level sensors 55. As described above, four ink cartridges 30 corresponding to the colors of cyan, magenta, yellow, and black can be accommodated in the cartridge receiving portion 110. Four contacts 52, one rod 125, one tank 103, and one liquid-level sensor 55 are provided for each of the four ink cartridges 30.

Note that the number of the ink cartridges 30 that can be accommodated in the cartridge receiving portion 110 is not limited to four. In FIG. 3, one of the four ink cartridges 30 is attached at a left end of the cartridge receiving portion 110.

The cartridge case 101 constitutes a casing of the cartridge receiving portion 110. The cartridge case 101 has a box shape formed with an interior space for accommodating four ink cartridges 30. The cartridge case 101 has a rear wall in the front-rear direction 8, and an opening 112 formed at a position opposing the rear wall in the front-rear direction 8. The opening 112 exposes the interior space of the cartridge case 101 to an outside. Further, in the open position of the cover 87, the opening 112 is exposed to the outside of the multifunction peripheral 10 through the opening 85 of the casing 14.

Each of the four ink cartridges 30 is inserted rearward and extracted frontward relative to the cartridge receiving portion 110 through both the opening 85 of the casing 14 and the opening 112 of the cartridge receiving portion 110. The cartridge case 101 includes a lower wall 117 formed with four guide grooves 109 spaced apart from one another in the left-right direction 9. A lower end portion of each of the ink cartridges 30 is inserted into the corresponding guide groove 109, and therefore the ink cartridge 30 can be guided in the front-rear direction 8.

The cartridge case 101 further includes three plates 104 for partitioning the interior space of the cartridge case 101 into four spaces adjacent to each other in the left-right direction 9. Each of the four spaces partitioned by the three plates 104 is configured to accommodate the corresponding one of the four ink cartridges storing ink of different colors.

<Contacts 52>

The contacts 52 are provided at a top wall of the cartridge case 101. Each of the contacts 52 protrudes downward from the top wall toward the interior space of the cartridge case 101. In a state where the ink cartridge 30 is attached to the cartridge case 101, each of the four contacts 52 is positioned at position in contact with a corresponding one of four electrodes 152 (see FIGS. 5 and 6; described later) of the ink cartridges 30. Each of the contacts 52 has electrical conductivity and is resiliently deformable in the up-down direction 7. Each of the contacts 52 is electrically connected to the controller 130 (see FIG. 8).

<Rods 125>

As illustrated in FIG. 4, each of the rods 125 protrudes frontward from the rear wall of the cartridge case 101. Each of the rods 125 is provided at the rear wall of the cartridge case 101 at a position upward relative to a corresponding one of joints 107 (described later). In a state where the ink cartridge 30 is attached to the cartridge receiving portion 110, the rod 125 is inserted into an air valve chamber 36 (described later) of the ink cartridge 30 through an air communication opening 96 (described later).

<Locking Portion 129>

As illustrated in FIGS. 3 and 4, the locking portion 129 extends in the left-right direction 9 at a position adjacent to the top wall of the cartridge case 101 and adjacent to the opening 112. The locking portion 129 is a bar-like member extending in the left-right direction 9. The locking portion 129 has a columnar shape and made of metal, for example. The locking portion 129 has a left end fixed to a left end wall of the cartridge case 101 and a right end fixed to a right end wall of the cartridge case 101. The locking portion 129 extends in the left-right direction 9 over the four spaces of the cartridge case 101 in which the four ink cartridges 30 are respectively accommodatable.

Figure 7:
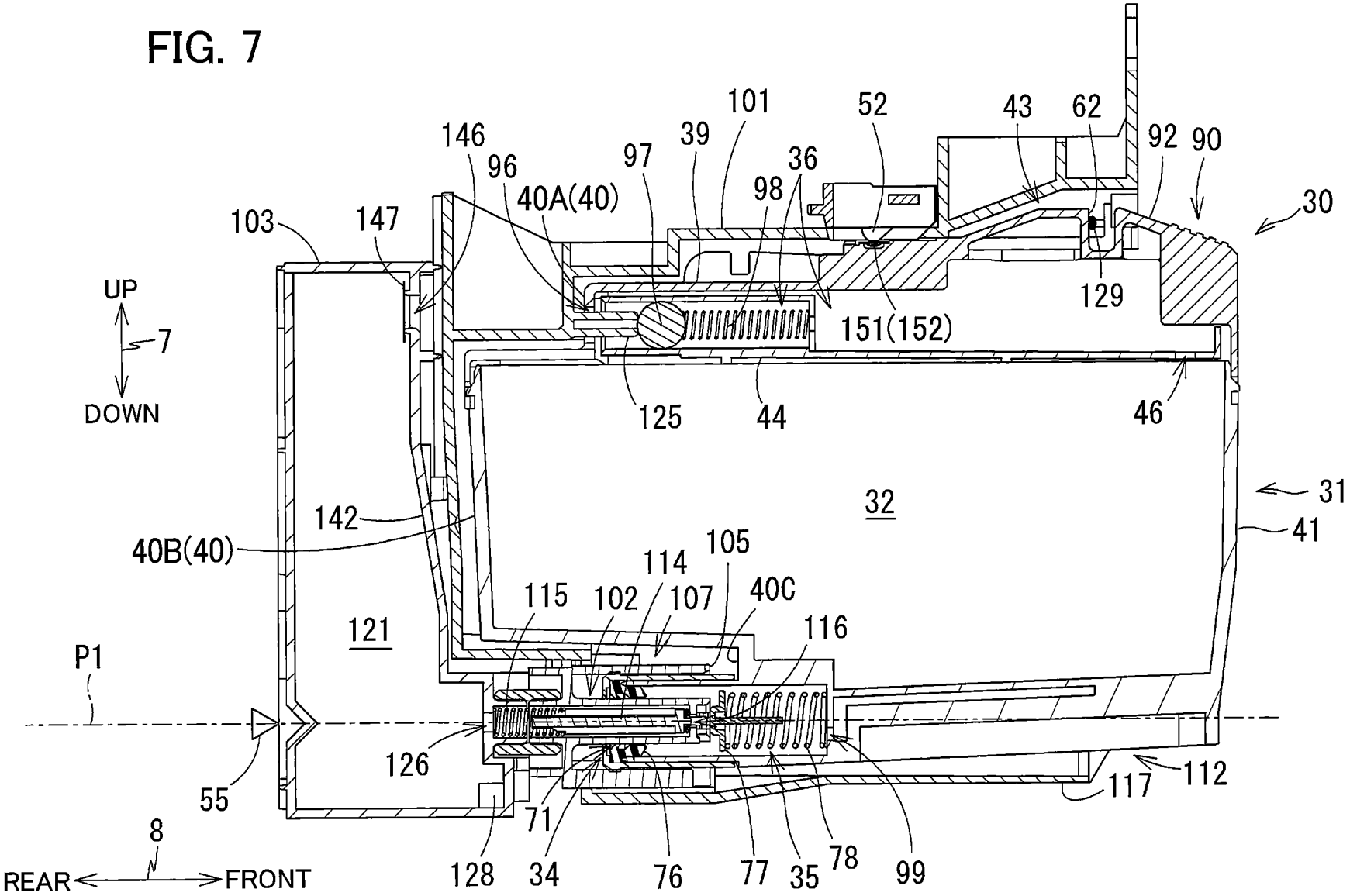
FIG. 7 is a vertical cross-sectional view of the cartridge receiving portion 110 and the ink cartridge 30 of the multifunction peripheral 10 according to the first embodiment, and illustrating a state where the ink cartridge 30 is attached to the cartridge receiving portion 110.

The locking portion 129 is configured to retain each of the ink cartridges 30 attached to the cartridge receiving portion 110 at an attached position illustrated in FIG. 7. The ink cartridges 30 are respectively configured to be engaged with the locking portion 129 in a state where the ink cartridges 30 are attached to the cartridge receiving portion 110. As a result, the locking portion 129 retains each ink cartridge 30 in the cartridge receiving portion 110 at the attached position against urging forces of coil springs 78, 98 (described later) that push the ink cartridge 30 frontward.

<Tanks 103>

As illustrated in FIG. 4, the tanks 103 are positioned rearward of the cartridge case 101. Of walls constituting each of the tanks 103, a rear wall 143 has a portion serves as a prism 55A (described later) of the liquid-level sensor 55. At least this portion of the rear wall 143 among the walls constituting each of the tank 103 has a translucency to allow a light emitted from a light-emitting portion 55B of the liquid-level sensor 55 to pass therethrough.

Each of the tanks 103 has a box-like shape defining therein a storage chamber 121 (an example of a second storage chamber). Each of the storage chambers 121 is in communication with the corresponding one of the ink tubes through an outlet port 128. The outlet port 128 is formed at a position adjacent to a bottom wall of the tank 103 defining a lower end of the storage chamber 121. The outlet port 128 is positioned downward of the joint 107. With this configuration, ink stored in the storage chamber 121 flows out through the outlet port 128 into the ink tube, and is supplied to the recording head through the ink tube.

Each of the tanks 103 also includes a front wall 142 formed with a communication port 146 and a through-hole 126. Each of the communication port 146 and the through-hole 126 penetrates the front wall 142 in the front-rear direction 8. The front wall 142 is formed with an opening constituting a front end of the communication port 146. The opening of the communication port 146 is closed with a semipermeable membrane 147 restricting ink from passing therethrough but allowing air to pass therethrough. Through the communication port 146 and the semipermeable membrane 147, the storage chamber 121 is in communication with an atmosphere. The communication port 146 and the semipermeable membrane 147 is an example of a second air communicating portion. Note that the semipermeable membrane 147 may not be provided on the communication port 146.

<Joints 107>

As illustrated in FIGS. 3 and 4, each of the joints 107 includes an ink needle 102 and a guide portion 105. The ink needle 102 has a hollow tubular shape and made of resin. The ink needle 102 protrudes frontward from the tank 103. The ink needle 102 has a protruding end formed with an opening 116. The ink needle 102 defines therein an internal space in communication with the storage chamber 121 through the through-hole 126. Further, the ink needle 102 is disposed at a position corresponding to an ink supply portion 34 (see FIG. 7) of the ink cartridge 30 attached to the cartridge receiving portion 110. The through-hole 126 is an example of an inlet port.

The guide portion 105 is a hollow cylindrical shape provided to surround the ink needle 102. The guide portion 105 protrudes frontward from the rear wall of the cartridge case 101 and has a protruding end formed with an opening. The ink needle 102 is disposed at a diametrical center of the guide portion 105. When the ink cartridge 30 is attached to the cartridge receiving portion 110, the ink supply portion 34 is inserted into an interior of the guide portion 105.

A valve 114 and a coil spring 115 are accommodated in the internal space of the ink needle 102. The valve 114 is movable in the front-rear direction 8 between a closed position (see FIG. 4) closing the opening 116 and an open position (see FIG. 7) opening the opening 116. The coil spring 115 urges the valve 114 toward the closed position, i.e., frontward. In a state where the valve 114 is in the closed position, a front end of the valve 114 protrudes further frontward relative to the opening 116.

<Liquid-Level Sensors 55>

Each of the liquid-level sensors 55 (an example of a detecting portion) includes the prism 55A, the light-emitting portion 55B, and a light-receiving portion (not illustrated). Each of the liquid-level sensor 55 is configured to detect, using the prism 55A, whether the level of the ink remaining in the storage chamber 121 is equal to or lower than a prescribed position P1. The prism 55A provides an optical reflectivity that varies depending on whether the ink remaining in the storage chamber 121 is in contact with the prism 55A.

In the present embodiment, the prescribed position P1 is a position the same as a center of the internal space of the ink needle 102 in the up-down direction 7. However, the prescribed position P1 may be a position other than the position described above. For example, the prescribed position P1 may be positioned downward relative to the ink needle 102 but positioned upward relative to the outlet port 128.

In the rear wall 143 defining the storage chamber 121, a portion adjacent to the prescribed position P1 constitutes the prism 55A. The light-emitting portion 55B and the light-receiving portion are positioned rearward of the prism 55A so as to oppose the prism 55A. The light-emitting portion 55B is configured to emit light toward the prism 55A, and the light-receiving portion is configured to receive the light emitted from the light-emitting portion 55B and reflected by the prism 55A. The light-receiving portion is configured to output a signal based on intensity of the received light to the controller 130.

When the level of the ink stored in the storage chamber 121 is higher than the prescribed position P1, the ink is in contact with the prism 55A on an optical path of light emitted from the light-emitting portion 55B. In this case, the light emitted from the light-emitting portion 55B to the prism 55A passes through the prism 55A and enters the storage chamber 121, whereby the light emitted from the light-emitting portion 55B does not reach the light-receiving portion. As a result, the light-receiving portion outputs a low-level signal to the controller 130.

On the other hand, when the level of the ink stored in the storage chamber 121 is equal to or lower than the prescribed position P1, the ink is not in contact with the prism 55A on the optical path of light emitted from the light-emitting portion 55B. In the latter case, light emitted from the light-emitting portion 55B to the prism 55A is reflected by the prism 55A and the light is allowed to reach the light-receiving portion. At this time, the light-receiving portion outputs a high-level signal to the controller 130.

Note that another well-known configuration may be employed as the liquid-level sensor 55. For example, an arm provided with a detected portion may be provided in the storage chamber 121. In this case, the arm is pivotally moved when the level of the ink in the storage chamber 121 is below the prescribed position P1 to displace the detected portion. As the optical sensor detects the displacement of the detected portion of the arm, whether the level of the ink is below the prescribed position P1 can be determined.

Alternatively, electrodes having bar-like shape may be used as the liquid-level sensors 55. In this case, the two electrodes are mounted on a circuit board (not illustrated) and disposed in the storage chamber 121. One of the two electrodes has a lower end positioned slightly upward relative to the prescribed position P1, while the remaining one of the two electrode has a lower end positioned downward relative to the prescribed position P1. Depending on whether current flows between the two electrodes through the ink stored in the storage chamber 121, whether the level of the ink stored in the storage chamber 121 becomes equal or lower than the prescribed position P1 can be detected.

<Ink Cartridges 30>

Figure 5:
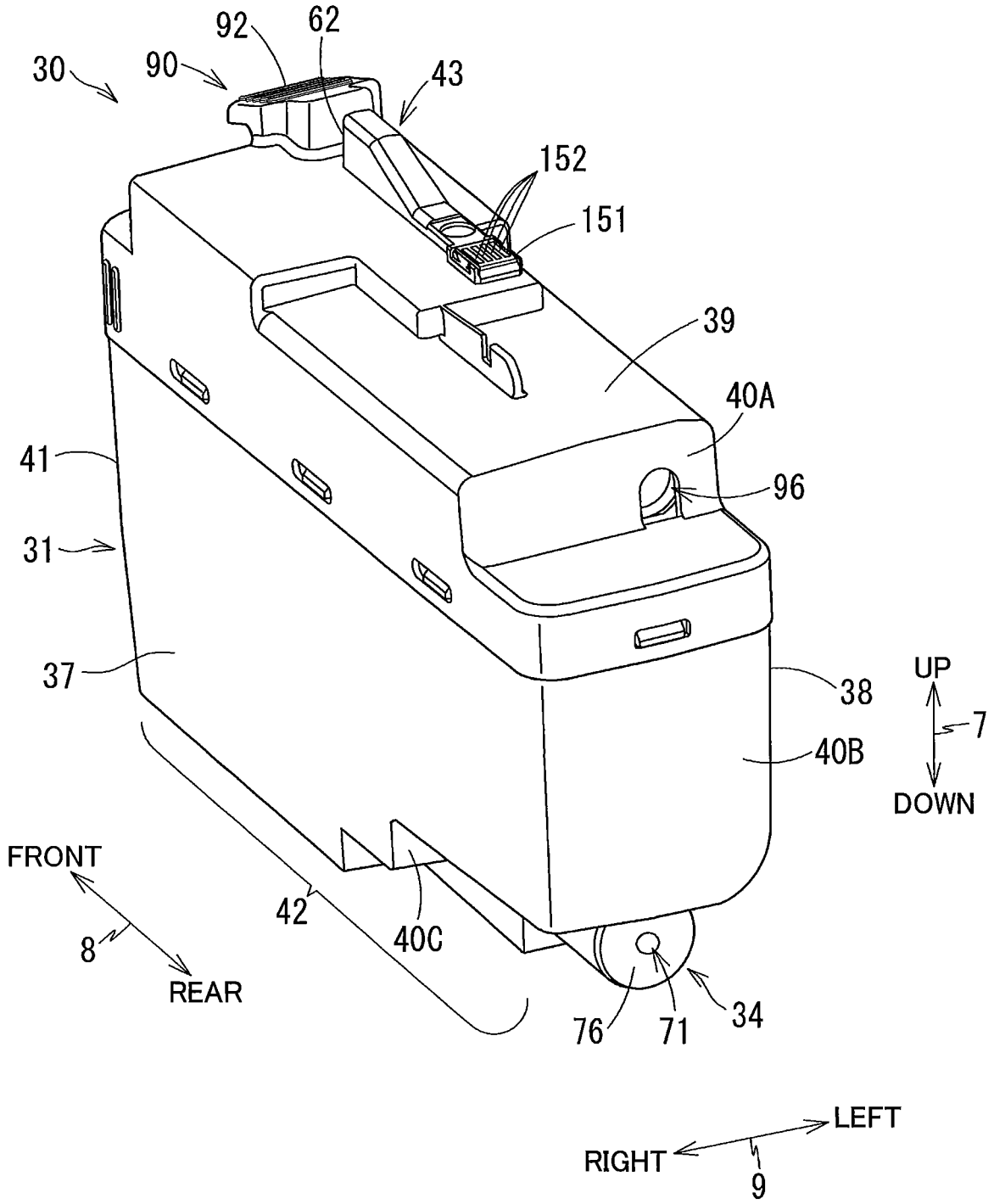
FIG. 5 is a perspective view of an ink cartridge 30 of the multifunction peripheral 10 according to the first embodiment as viewed from the rear side.
Figure 6:
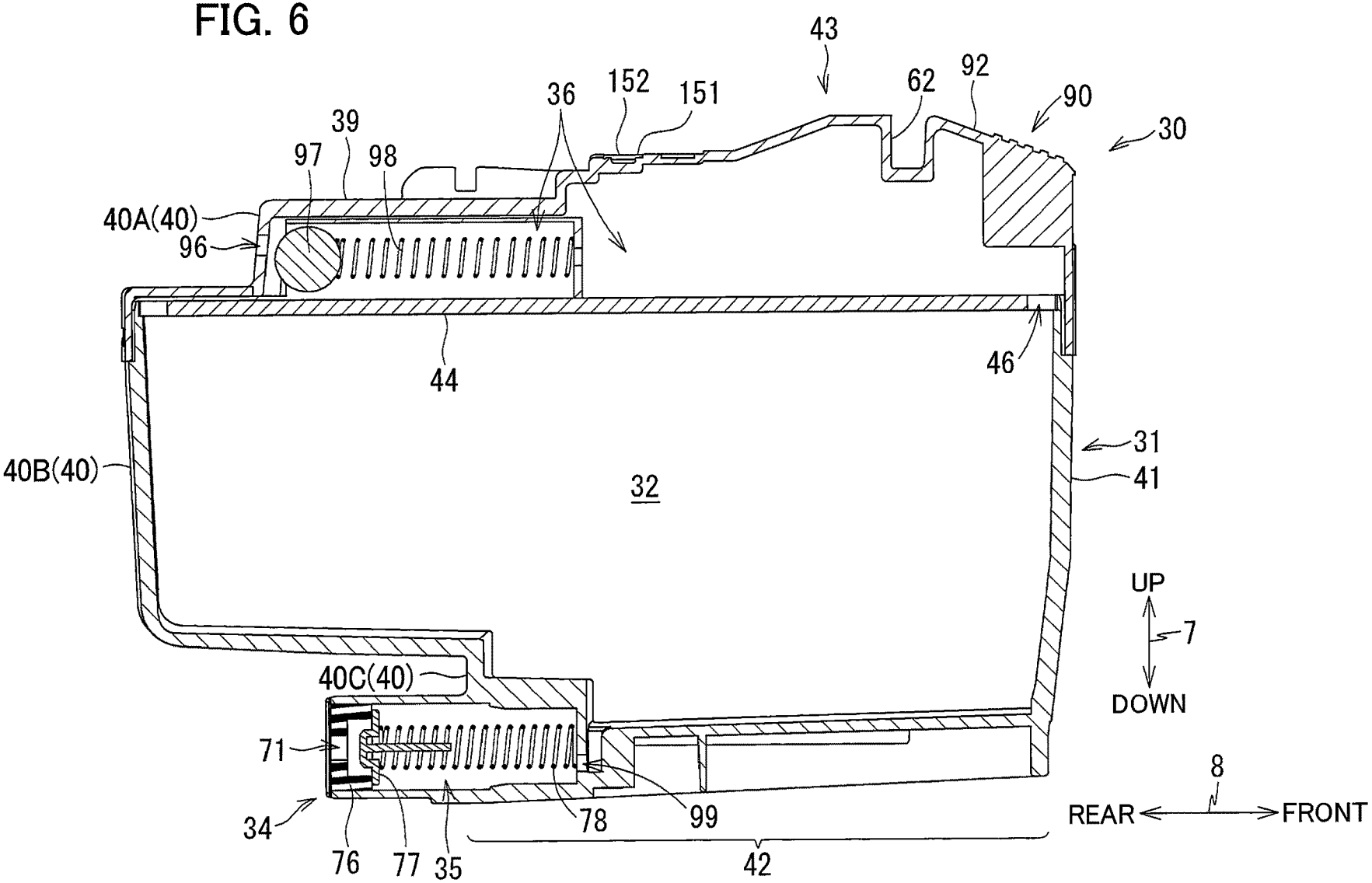
FIG. 6 is a vertical cross-sectional view of the ink cartridge 30 of the multifunction peripheral 10 according to the first embodiment.

Each of the ink cartridges 30 (an example of a cartridge) is a container configured to store ink (an example of liquid) therein. As illustrated in FIGS. 5 and 6, the ink cartridge 30 includes a cartridge casing 31, the ink supply portion 34, a projecting portion 43, and an operation portion 90. The cartridge casing 31 has a flattened shape so that a dimension of the cartridge casing 31 in the left-right direction 9 is small, and a dimension of the cartridge casing 31 in the up-down direction 7 and a dimension of the cartridge casing 31 in the front-rear direction 8 are greater than the dimension of the cartridge casing 31 in the left-right direction 9.

The ink cartridges 30 storing ink of colors different from one another may have outer shapes the same as one another, or may have outer shapes different from one another. The cartridge casing 31 is defined by a rear wall 40, a front wall 41, an upper wall 39, a lower wall 42, a right side wall 37, and a left side wall 38.

The rear wall 40 is constituted by a first rear wall 40A, a second rear wall 40B, and a third rear wall 40C. The first rear wall 40A is positioned frontward and upward relative to the second rear wall 40B. The second rear wall 40B is positioned rearward and upward relative to the third rear wall 40C. Further, the third rear wall 40C is positioned frontward and downward relative to the first rear wall 40A. The air communication opening 96 is formed at the first rear wall 40A. The ink supply portion 34 is provided at the third rear wall 40C.

The projecting portion 43 and the operation portion 90 is provided on the upper wall 39. The projecting portion 43 protrudes upward from an outer surface of the upper wall 39 and extends in the front-rear direction 8. The projecting portion 43 has a lock surface 62 facing frontward. The lock surface 62 is positioned upward relative to the upper wall 39. In a state where the ink cartridge 30 is attached to the cartridge receiving portion 110, the lock surface 62 is in contact with the locking portion 129 of the cartridge receiving portion 110. Contact of the lock surface 62 with the locking portion 129 allows the ink cartridge 30 to be retained at the attached position against the urging force of the coil springs 78, 98.

On the upper wall 39, the operation portion 90 is positioned frontward relative to the lock surface 62. The operation portion 90 has an operation surface 92. When the operation surface 92 is pressed downward by the user in a state where the ink cartridge 30 is attached to the cartridge receiving portion 110, the ink cartridge 30 is pivotally moved, and the lock surface 62 is moved downward relative to the locking portion 129. As a result, the ink cartridge 30 can be removed from the cartridge receiving portion 110.

As illustrated in FIG. 6, a storage chamber 32, an ink valve chamber 35, and the air valve chamber 36 are formed in an internal space of the cartridge casing 31. The storage chamber 32 and the ink valve chamber 35 are configured to store ink therein. The storage chamber 32 and the ink valve chamber 35 is an example of a first storage chamber. The storage chamber 32 is in communication with an outside of the cartridge casing 31 through the air valve chamber 36 to open to the atmosphere.

The cartridge casing 31 has a partition wall 44 for partitioning the internal space of the cartridge casing 31. The storage chamber 32 and the air valve chamber 36 are partitioned by the partition wall 44 to be arranged adjacent to each other in the up-down direction 7. The storage chamber 32 and the air valve chamber 36 are in communication with each other via a through-hole 46 formed on the partition wall 44. The storage chamber 32 and the ink valve chamber 35 are in communication with each other via a through-hole 99.

The air valve chamber 36 serves as an air flow passage and is provided at a position upward relative to the storage chamber 32. A labyrinth passage or a semipermeable membrane (not illustrated) may be provided at the air valve chamber 36. A valve 97 and the coil spring 98 are accommodated within the air valve chamber 36. The valve 97 is movable between a closed position (see FIG. 6) closing the air communication opening 96 and an open position (see FIG. 7) opening the air communication opening 96. The coil spring 98 urges the valve 97 toward the closed position, i.e., rearward. The air valve chamber 36 and the valve 97 is an example of a first air communicating portion.

During process of attachment of the ink cartridges 30 to the cartridge receiving portion 110, the rod 125 of the cartridge receiving portion 110 (see FIG. 7) enters the air valve chamber 36 through the air communication opening 96. As the rod 125 enters the air valve chamber 36, the rod 125 moves the valve 97 in the closed position frontward against the urging force of the coil spring 98. As the valve 97 is moved to the open position, the storage chamber 32 is in communication with the atmosphere through the air valve chamber 36 and the air communication opening 96.

Note that a configuration for opening the air communication opening 96 may be different from the configuration in the present embodiment. For example, the air communication opening 96 may be sealed with a film, and the rod 125 may break through the film to allow the air communication opening 96 to open.

The ink supply portion 34 protrudes rearward from the third rear wall 40C. The ink supply portion 34 has a hollow cylindrical shape. The ink supply portion 34 has an internal space serving as the ink valve chamber 35. The ink supply portion 34 has a protruding end open to outside of the ink cartridge 30. The second rear wall 40B is positioned further rearward relative to the protruding end of the ink supply portion 34. Within the ink valve chamber 35, a seal member 76, a valve 77, and the coil spring 78 are accommodated.

The seal member 76 has a disc-like shape formed with a through-hole in a diametrical center of the seal member 76. This through-hole penetrating the seal member 76 in the front-rear direction 8 functions as an ink supply port 71. The ink supply port 71 has an inner diameter slightly smaller than an outer diameter of the ink needle 102. The valve 77 is movable in the front-rear direction 8 between a closed position (see FIG. 6) and an open position (see FIG. 7) within the ink valve chamber 35. In the closed position, the valve 77 is in abutment with the seal member 76 to close the ink supply port 71, while in the open position, the valve 77 is separated from the seal member 76 to open the ink supply port 71. The coil spring 78 urges the valve 77 in a direction toward the closed position, i.e., rearward. In a state where the valve 77 is at the open position, the ink stored in the ink valve chamber 35 flows out through the ink supply port 71. On the other hand, in a state where the valve 77 is at the closed position, the ink is restricted from flowing out through the ink supply port 71.

In the process of attaching the ink cartridge 30 to the cartridge receiving portion 110, the ink supply port 71 of the ink cartridge 30 is connected to the ink needle 102 (see FIG. 7) of the tank 103. Specifically, the ink needle 102 is inserted into the ink valve chamber 35 through the ink supply port 71. At this time, an outer peripheral surface of the ink needle 102 provides liquid-tight contact with an inner peripheral surface of the seal member 76 defining the ink supply port 71 while elastically deforming the seal member 76. As the ink cartridge 30 is further inserted into the cartridge receiving portion 110, the ink needle 102 moves the valve 77 toward the open position against the urging force of the coil spring 78. The valve 77 causes the valve 114 protruding through the opening 116 of the ink needle 102 to move to the open position against the urging force of the coil spring 115, thereby opening the opening 116.

As a result, as illustrated in FIG. 7, the ink supply port 71 and the opening 116 are open, whereby ink is allowed to flow from the ink valve chamber 35 of the ink supply portion 34 to the internal space of the ink needle 102. Accordingly, the ink stored in the storage chamber 32 and the ink valve chamber 35 can be supplied into the storage chamber 121 of the tank 103 due to hydraulic head difference. More specifically, the ink stored in the storage chamber 32 and the ink valve chamber 35 flows out through the ink supply port 71, passes through the internal space of the ink needle 102 of the joint 107 connected to the ink supply portion 34, and flows into the storage chamber 121 of the tank 103 through the through-hole 126.

As illustrated in FIGS. 5 and 6, the ink cartridge 30 further includes a circuit board 151 positioned rearward of the projecting portion 43 on the outer surface of the upper wall 39. The electrodes 152 are formed on the circuit board 151. Further, the circuit board 151 includes a memory 153 (see FIG. 8). The electrodes 152 are electrically connected to the memory 153 of the circuit board 151. On an upper surface of the circuit board 151, the electrodes 152 are exposed to an outside so as to be electrically connectable to the contacts 52 of the cartridge receiving portion 110.

In a state where the ink cartridge 30 is attached to the cartridge receiving portion 110, each of the electrodes 152 is electrically connected to the corresponding one of the contacts 52. The controller 130 can read information from the memory 153 of the circuit board 151 and can write information into the memory 153 of the circuit board 151 through the contacts 52 and the electrodes 152.

The memory 153 of the circuit board 151 stores therein: viscosity of the liquid ρ; an ink amount Vc (an example of a first liquid amount); a length Hc; a resistance Rc; and a function Fc.

The viscosity of the liquid ρdenotes viscosity of the ink stored in the ink cartridge 30.

The ink amount Vc denotes an amount of the ink stored in the storage chamber 32 and the ink valve chamber 35 of the ink cartridge 30.

The length Hc denotes a height of the level of the ink stored in the storage chamber 32 and the ink valve chamber 35 of the ink cartridges 30 relative to a reference position. In other words, the length Hc denotes a length in the up-down direction 7 between the reference position and the level of the ink stored in the storage chamber 32 and the ink valve chamber 35 of the ink cartridge 30.

Here, the reference position denotes a position in the up-down direction 7 set in common for both the ink cartridge 30 and the tank 103 in a state where the ink cartridge 30 is attached to the cartridge receiving portion 110. In the present embodiment, the reference position is a position the same as an imaginary line passing through the center of the internal space of the ink needle 102 and extending in the horizontal direction (more specifically, the front-rear direction 8). That is, the prescribed position P1 serves as the reference position in the present embodiment.

The resistance Rc denotes a resistance imposed upon the air passing through the air valve chamber 36.

The function Fc is information indicative of a correspondence relationship between the ink amount Vc and the length Hc. The length Hc is calculated using an expression (1) indicated below. The function Fc is preset information and uses the ink amount Vc and the length Hc as variables. The information indicative of the correspondence relationship between the ink amount Vc and the length Hc may take a format of a data table including information other than the function Fc, such as a plurality of sets of the corresponding ink amount Vc and the corresponding length Hc.

$$Hc=Fc(Vc) \tag{1}$$

The memory 153 of the circuit board 151 has a storage area including, for example, a first area and a second area. The first area and the second area are memory areas different from each other. Information stored in the first area is not rewritable by the controller 130, while information stored in the second area is rewritable by the controller 130. The first area stores therein the viscosity of the liquid ρ, the passage resistance Rc, and the function Fc. The second area stores therein the ink amount Vc and the length Hc.

<Controller 130>

Figure 8:
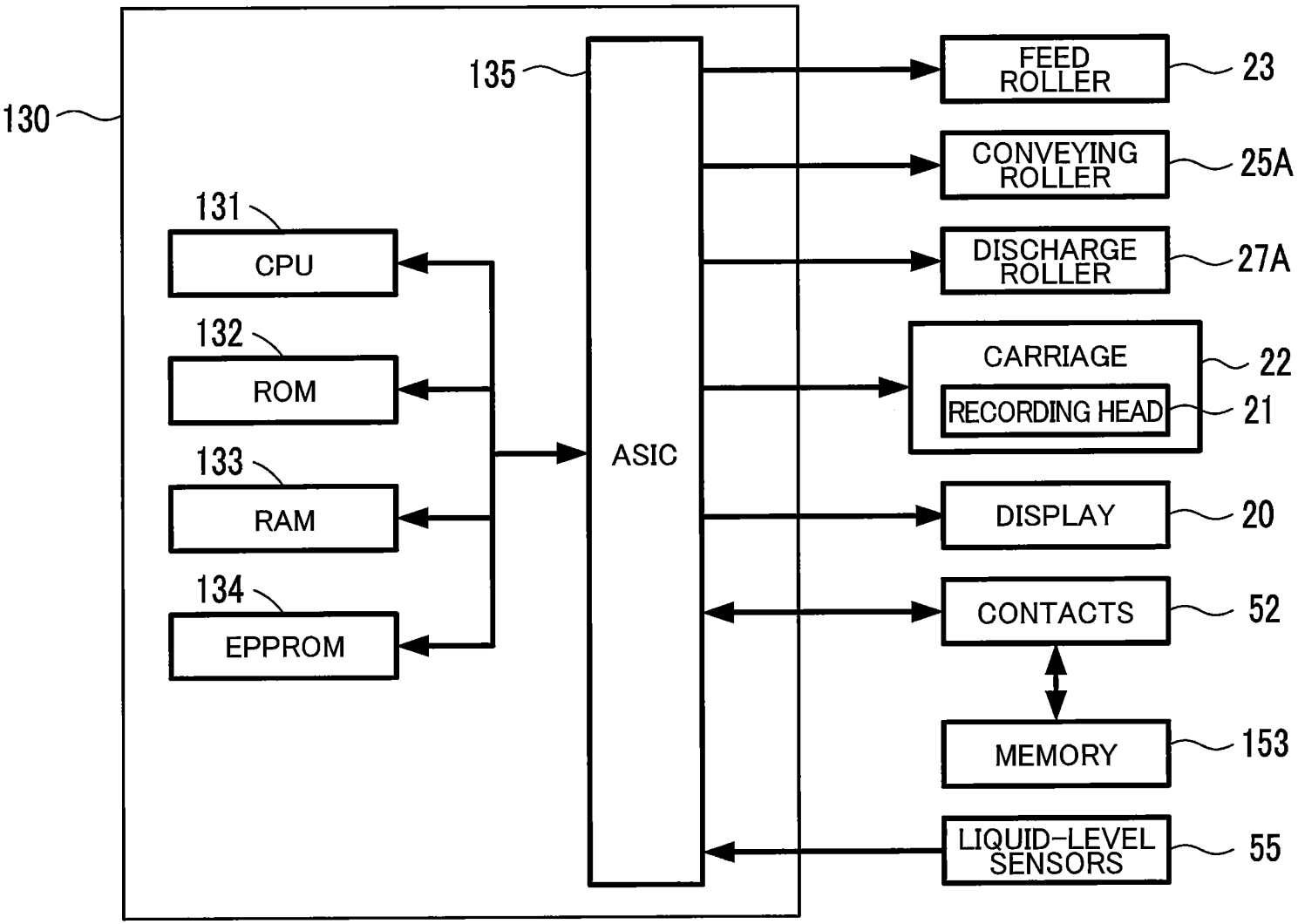
FIG. 8 is a block diagram of the multifunction peripheral 10 according to the first embodiment.

The controller 130 is configured to control overall operations of the multifunction peripheral 10. As illustrated in FIG. 8, the controller 130 includes a central processing unit (CPU) 131, a read-only memory (ROM) 132, a random-access memory (RAM) 133, an electrically erasable programmable ROM (EEPROM) 134, and an application-specific integrated circuit (ASIC) 135. The ROM 132 stores programs and the like with which the CPU 131 controls various operations in the multifunction peripheral 10. The RAM 133 is used as a storage area for temporarily storing data, signals, and the like used when the CPU 131 executes the programs. The RAM 133 is also used as a working area in which data processing is performed. The EEPROM 134 stores settings information that need be preserved after the multifunction peripheral 10 is turned off. The ROM 132, the RAM 133, the EEPROM 134 and the memory 153 of the circuit board 151 is an example of a memory.

The ASIC 135 operates the feed roller 23, the conveying roller 25A, the discharge roller 27A, and the recording head 21. The controller 130 causes the ASIC 135 to drive the motors (not illustrated) to rotate the feed roller 23, the conveying roller 25A, and the discharge roller 27A. Further, the controller 130 controls the ASIC 135 to output drive signals to the vibrating elements of the recording head 21, thereby causing the recording head 21 to eject ink through the nozzles 29. The ASIC 135 is capable of outputting a plurality of kinds of drive signals in accordance with required amount of ink to be ejected through the nozzles 29. The display 20 is connected to the ASIC 135.

Further, the contacts 52 and the liquid-level sensors 55 are electrically connected to the ASIC 135. The controller 130 provides communication with the memory 153 of each ink cartridge 30 attached to the cartridge case 101 through the corresponding contacts 52. The controller 130 determines whether the level of the ink stored in each of the storage chambers 121 is equal to or lower than the prescribed position P1 using the corresponding one of the liquid-level sensors 55.

The EEPROM 134 stores therein various kinds of information relating to the four ink cartridges 30 to be respectively attached to the cartridge case 101, i.e., information relating to the tanks 103 to be respectively in communication with the corresponding ink cartridges 30. The various kinds of information includes, for example, the ink amount Vc, an ink amount Vs (an example of a second liquid amount), the length Hc, a length Hs, the resistance Rc, a resistance Rs, a resistance Rn, the function Fc, a function Fs, and a threshold amount Vth. The resistance Rs, the resistance Rn and the function Fs may be stored in the ROM 132 instead of the EEPROM 134.

The ink amount Vc, the length Hc, the resistance Rc, and the function Fc are information to be read by the controller 130 from the memory 153 of each ink cartridge 30 through the corresponding contacts 52 in a state where the ink cartridges 30 are attached to the cartridge receiving portion 110.

The ink amount Vs denotes an amount of the ink stored in the storage chamber 121 of the tank 103.

The length Hs denotes a height of the level of the ink stored in the storage chamber 121 of the tank 103 relative to the reference position described above In other words, the length Hs denotes a length in the up-down direction 7 between the reference position and the level of the ink stored in the storage chamber 121 of the tank 103.

The resistance Rs denotes a resistance imposed upon the air passing through the communication port 146 and the semipermeable membrane 147.

The resistance Rn denotes a resistance imposed upon the ink passing through the ink valve chamber 35 and the internal space of the ink needle 102 in communication with each other. In other words, the resistance Rn denotes a resistance imposed upon the ink flowing from the storage chamber 32 into the storage chamber 121.

The function Fs is information indicative of a correspondence relationship between the ink amount Vs and the length Hs. The length Hs is calculated using an expression (2) indicated below. The function Fs is a preset function and uses the ink amount Vs and the length Hs as variables. The information indicative of the correspondence relationship between the ink amount Vs and the length Hs may take a format of a data table including information other than the function Fs, such as a plurality of sets of the corresponding ink amount Vs and the corresponding length Hs.

$$Hs=Fs(Vs) \tag{2}$$

Figure 10A:
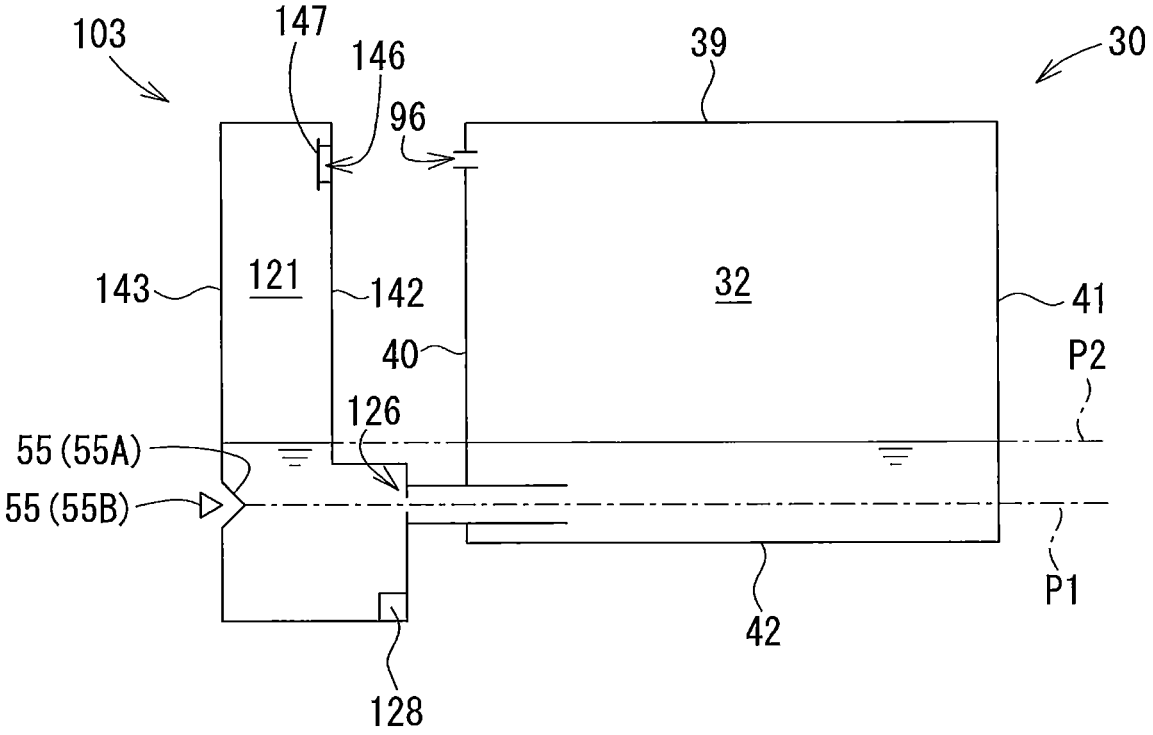
FIG. 10A is a schematic diagram illustrating a tank 103 of the cartridge receiving portion 110 and the ink cartridge 30 of the multifunction peripheral 10 according to the first embodiment, and illustrating a state where the tank 103 and the ink cartridge 30 are connected to each other and a level of ink stored in the tank 103 is the same as a level of ink stored in the ink cartridge 30.
Figure 10B:
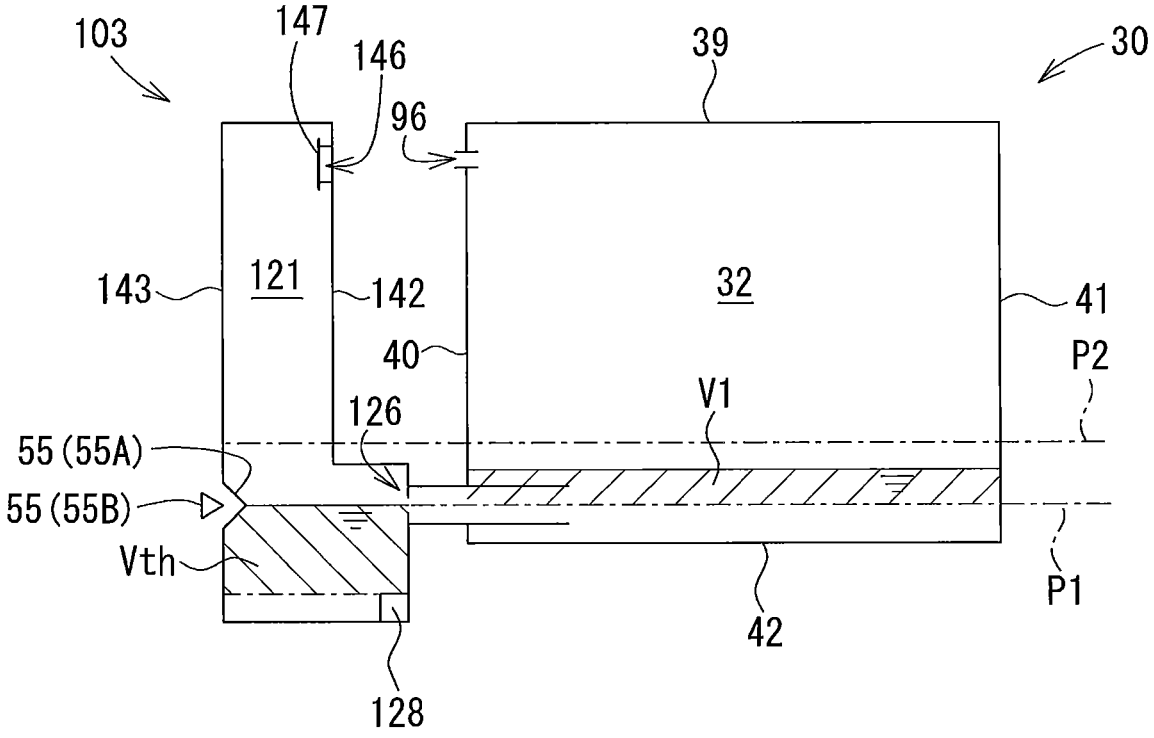
FIG. 10B is a schematic diagram illustrating the tank 103 and the ink cartridge 30 of the multifunction peripheral according to the first embodiment, and illustrating a state where the tank 103 and the ink cartridge 30 are connected to each other and the level of ink stored in the tank 103 differs from the level of ink stored in the ink cartridge 30.

The threshold amount Vth is a value regarding an ink amount preset for preventing air from passing through the outlet port 128 of the tank 103. In the present embodiment, the threshold amount Vth is set to a value corresponding to an amount of the ink capable of being stored in a space defined between the prescribed position P1 and an upper end of the outlet port 128 in the storage chamber 121 of the tank 103. In FIG. 10B, the threshold amount Vth corresponds to an amount of the ink indicated by a hatching area in the storage chamber 121.

<Print Control Process Performed by Controller 130>

Figure 9A:
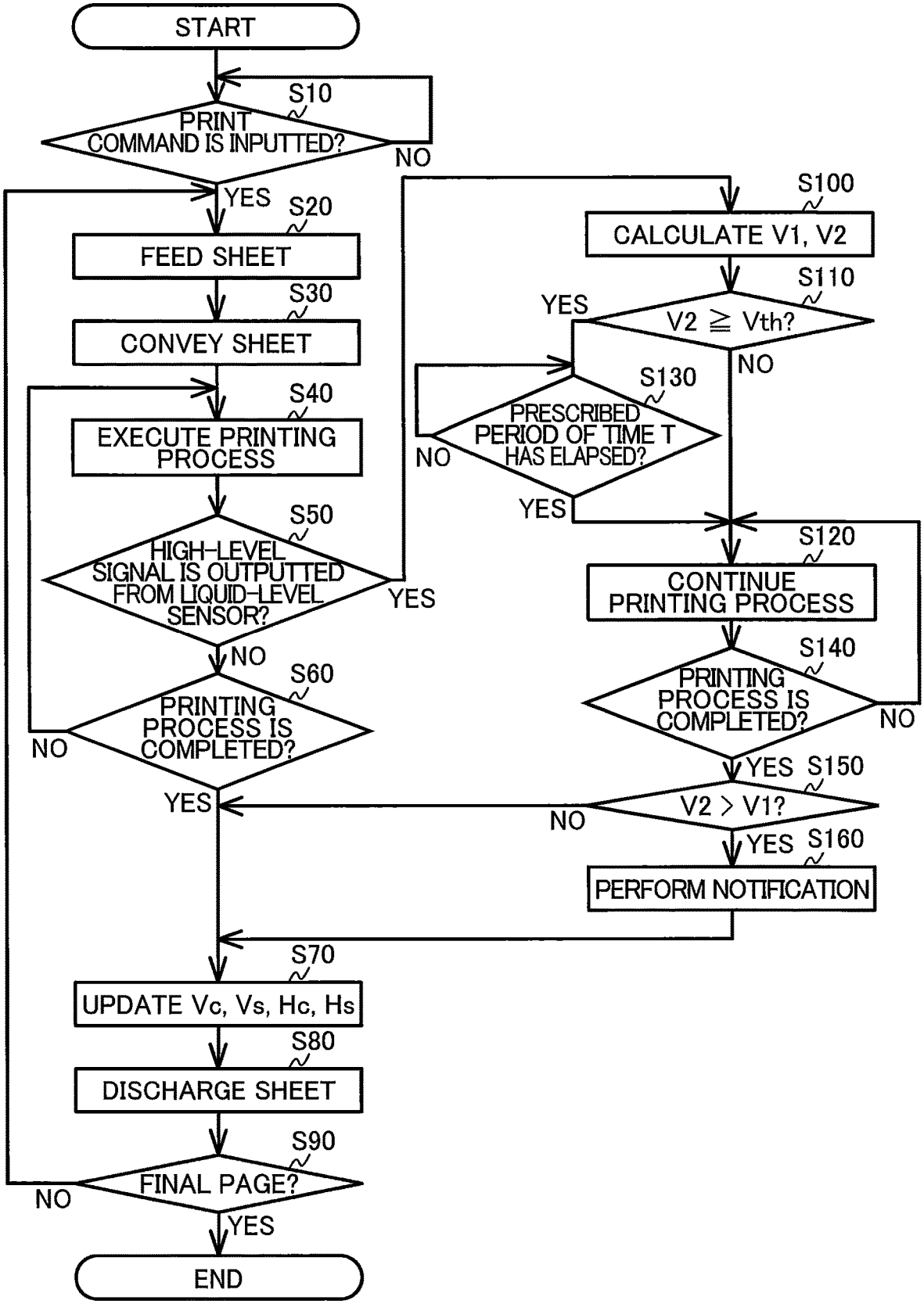
FIG. 9A is a flowchart illustrating steps in a print control process executed by a controller 130 of the multifunction peripheral 10 according to the first embodiment.

The controller 130 executes a print control process to control the printer portion 11 configured as described above. In the print control process, the printer portion 11 is controlled so as to feed each of the sheets 12 and an image is recorded on each sheet 12. Hereinafter, the print control process will be described with reference to the flowchart in FIG. 9A. Note that, in an initial state when the print control process is performed, it is assumed that the level of the ink stored in the storage chamber 32 of the ink cartridge 30 and the level of the ink stored in the storage chamber 121 of the tank 103 are the same as each other, i.e., the same as a position P2 that is above the liquid-level sensor 55, as illustrated in FIG. 10A.

In the print control process according to the present embodiment, the controller 130 determines whether a print command (an example of a command to consume liquid) has been inputted to the controller 130. The controller 130 waits until a print command is inputted (S10: NO). When a print command is inputted into the controller 130 from the operating portion 28 (see FIG. 1) of the multifunction peripheral 10 or an external device connected to the multifunction peripheral 10 (S10: YES), in S20 the controller 130 controls the feed roller 23 to starts feeding the sheet 12 supported by the feed tray 15 to the conveying path 17.

The print command includes various information such as print data for image to be recorded onto each of the sheets 12, the size of the sheets 12 on which the image is to be printed, margins of the sheets 12 on which the image is to be printed, and the number of sheets 12 on which the image is to be printed.

The controller 130 executes a printing process to print an image onto each of the sheets 12 (an example of a consuming process) based on the inputted print command. In the present embodiment, the process performed in a case where information included in the print command indicates that an image is to be printed onto a plurality of the sheets 12 and the printing process is executed based on the print command will be described.

In S30 the controller 130 controls the conveying roller pair 25 to start conveyance of one sheet 12. More specifically, the controller 130 controls the conveying roller pair 25 to convey the sheet 12 in the conveying direction so that the sheet 12 reaches a print starting position at which the sheet 12 faces the recording portion 24. When the sheet 12 is at the print starting position, a downstream end in the conveying direction of a print region (i.e., a region of the sheet 12 on which an image is printed based on image data) of each sheet 12 faces some nozzles 29 arranged at positions most downstream in the conveying direction among the plurality of nozzles 29.

Then, in S40 the controller 130 performs a printing process onto the conveyed sheet 12. Specifically, the controller 130 controls the conveying roller pair 25 and the recording portion 24 to alternately and repeatedly perform conveyance of the sheet 12 by the conveying roller pair 25 and ejection of ink droplets through the nozzles 29 by the recording portion 24 while moving the carriage 22. During execution of the printing process, the ink stored in the storage chambers 121 of the tanks 103 and the ink stored in the storage chambers 32 of the ink cartridges 30 are supplied to the recording head 21.

While the printing process onto the sheet 12 is performed, the controller 130 refers to a signal outputted from each of the liquid-level sensors 55 to the controller 130. In other words, during execution of the printing process in S40, in S50 the controller 130 determines whether the liquid-level sensor 55 outputs a high-level signal. When the signal outputted from the liquid-level sensor 55 to the controller 130 is a low-level signal (S50: NO), the controller 130 determines that the level of the ink stored in the corresponding storage chamber 121 is higher than the prescribed position P1. In this case, the controller 130 continues to control the recording portion 24 and the conveying roller pair 25 to execute the printing process until the printing process onto the sheet 12 has been completed (S60: NO).

When the controller 130 determines that the printing process onto the sheet 12 has been completed (S60: YES), in S70 the controller 130 updates the ink amount Vc, the ink amount Vs, the length Hc, and the length Hs stored in the EEPROM 134.

Hereinafter, updating of the ink amount Vc, the ink amount Vs, the length Hc, and the length Hs will be described in detail. At a timing before the controller 130 executes the process in S70, the controller 130 calculates ink ejection amounts Qh, Qs, and Qc (described later).

The ink ejection amount Qh denotes an ink amount which the controller 130 commanded the recording head 21 to eject for forming an image onto one sheet 12. The controller 130 calculates the ink ejection amount Qh on a basis of the print data included in the print command. As an example, by referring to the print data, the controller 130 calculates, for each dot included in a print region of the sheet 12, the number of types of ink droplets to be ejected in the printing process, and the number of times of ejection of ink droplets for each type. For example, ink droplets of one type are to be ejected when the target dot should be color of black, while ink droplets of one to three types are to be ejected when the target dot should be color other than black. Further, as a density of color for the target dot is increased, the number of times the ink droplets are ejected are also increased.

The controller 130 calculates a value for each of four types of ink droplets by multiplying the number of times the ink droplets are to be ejected onto each dot in the printing region of the sheet 12. That is, the controller 130 calculates the ink ejection amount Qh for each of the four tanks 103, i.e., each of four colors. Note that the ink ejection amount Qh for only one of the four tanks 103 will be described.

As shown in an expression (3) indicated below, the ink ejection amount Qh is the total of the ink ejection amount Qs and the ink ejection amount Qc. The ink ejection amount Qs denotes an amount of the ink to be supplied from the storage chamber 121 of the tank 103 to the recording head 21 in the printing process executed for the sheet 12, and the ink ejection amount Qc denotes an amount of the ink to be supplied from the storage chamber 32 of the ink cartridge 30 to the recording head 21 in the printing process executed for the sheet 12. The ink ejection amounts Qs and Qc are calculated using an expression (4) and an expression (5) indicated below, respectively, based on the resistances Rs, Rc, and Rn.

$$Qh=Qs+Qc \tag{3}$$

$$Qs=Qh\cdot((Rn+Rc)/(Rs+Rn+Rc)) \tag{4}$$

$$Qc=Qh\cdot(Rs/(Rs+Rn+Rc)) \tag{5}$$

In the present embodiment, the values of the resistances Rs, Rc, and Rn are preset such that an inequation Rn+Rc>Rs is satisfied. Accordingly, in the printing process for forming an image onto the sheet 12, the ink ejection amount Qs becomes greater than the ink ejection amount Qc.

In S70, based on the ink ejection amounts Qh, Qs, and Qc calculated in advance, the controller 130 updates a value of ink amount Vs stored in the EEPROM 134 to a value obtained by subtracting the ink ejection amount Qs from the ink amount Vs stored in the EEPROM 134 before the updating in S70 (a value obtained by Vs−Qs). The controller 130 further updates a value of the ink amount Vc stored in the EEPROM 134 to a value obtained by subtracting the ink ejection amount Qc from the ink amount Vc stored in the EEPROM 134 before the updating in S70 (a value obtained by Vc−Qc). The controller 130 further updates a value of the length Hs stored in the EEPROM 134 to a value calculated based on the updated ink amount Vs and the expression (2) described above. The controller 130 further updates a value of the length Hc stored in the EEPROM 134 to a value calculated based on the updated ink amount Vc and the expression (1) described above.

Each time the printing process for one sheet 12 has been completed, the controller 130 updates the values of the ink amount Vc, the ink amount Vs, the length Hc, and the length Hs in the present embodiment.

Then, in S80 the controller 130 controls the discharge roller pair 27 to convey the sheet 12 in the conveying direction and to discharge the sheet 12 onto the discharge tray 16.

Next, in S90 the controller 130 determines whether the all of the print data included in the print command received in S10 has been printed onto the sheets 12. That is, in S90 the controller 130 determines whether the sheet 12 that has been printed in the latest printing process is the final page.

When the sheet 12 that has been printed in the latest printing process is not the final page (S90: NO), the controller 130 returns to the process in S20, and controls the feed roller 23 to feed the subsequent sheet 12 that serves as the next page and supported by the feed tray 15 to the conveying path 17. Then, the controller 130 executes the processes in S30 to S80, i.e., performs a printing process for the subsequent sheet 12.

On the other hand, when the sheet 12 that has been printed in the latest printing process is the final page (S90: YES), the controller 130 ends the series of processes.

Various processes, such as feeding of the subsequent sheet 12 serving as the next page by the feed roller 23 (S20), updating of the ink amount Vc, the ink amount Vs, the length Hc, and the length Hs (S70), discharge of the sheet 12 serving as the present page (i.e., the sheet 12 printed in the current printing process) (S80), and determination of whether the present page is the final page (S90) may be executed in parallel.

When the signal outputted from at least one of the liquid-level sensors 55 is changed from a low-level signal to a high-level signal (S50: YES), the controller 130 determines that the level of the ink stored in the corresponding storage chamber 121 has lowered to the prescribed position P1. In this case, the controller 130 executes the processes in S100 to S160 which will be described below in detail.

In S100 the controller 130 first calculates a first volume V1 and a second volume V2.

The calculation method of the first volume V1 will be described in detail. The first volume V1 denotes an amount of the ink stored in the storage chamber 32 in a region above the level of the ink stored in the storage chamber 121 at a timing when the liquid-level sensor 55 detects that the level of the ink stored in the storage chamber 121 becomes equal to or lower than the prescribed position P1 (i.e., when the signal outputted from the liquid-level sensor 55 to the controller 130 is changed from a low-level to a high-level).

As described above, the ink ejection amount Qs becomes greater than the ink ejection amount Qc during a printing process. Accordingly, at a timing when the liquid-level sensor 55 detects that the ink of the level stored in the storage chamber 121 is equal to or lower than the prescribed position P1, the level of the ink stored in the storage chamber 121 is lower than the level of the ink stored in the storage chamber 32. At this time, of the ink stored in the storage chamber 32, an amount of the ink above the level of the ink stored in the storage chamber 121 is the first volume V1. The first volume V1 is an example of a first volume.

FIG. 10B illustrates the level of the ink in the storage chamber 32 of the ink cartridge 30 and the level of the ink in the storage chamber 121 of the tank 103 at a timing when the liquid-level sensor 55 detects lowering of the level of the ink in the storage chamber 121. The first volume V1 corresponds to an ink amount indicated by a hatching area in the storage chamber 32 in FIG. 10B.

The controller 130 calculates the first volume V1 based on an expression (6) and an expression (7) indicated below. The expression (6) is an example of the claimed expression (1), and the expression (7) is an example of the claimed expression (2).

$$V1=V3-t1\cdot V4 \quad (6)$$

$$V4=(\rho\cdot g\cdot(Hc-Hs))/(Rc+Rs+Rn) \quad (7)$$

In the expression (6), a third volume V3 denotes an amount of the ink consumed by the recording head 21 since the printing process has started in response to receipt of the print command until the liquid-level sensor 55 detects that the level of the ink in the storage chamber 121 becomes to the prescribed position P1. In other words, the third volume V3 denotes an amount of the ink that has been supplied from the storage chamber 121 of the tank 103 and the storage chamber 32 of the ink cartridge 30 to the recording head 21 since the printing process has started in response to receipt of the print command until the liquid-level sensor 55 detects that the level of the ink in the storage chamber 121 becomes to the prescribed position P1.

For example, when a print command that commands to execute printing processes for ten sheets 12 is inputted to the controller 130 and when the liquid-level sensor 55 detects that the level of the ink in the storage chamber 121 lowers to the prescribed position P1 while the printing process for the eighth sheet 12 is executed, the third volume V3 denotes an amount of the ink supplied from the storage chamber 32 and the storage chamber 121 to the recording head 21 since the printing process for the first sheet 12 has started until the liquid-level sensor 55 detects that the level of the ink in the storage chamber 121 becomes equal to or lower than the prescribed position P1 while the printing process for the eighth sheet 12 is being executed. Similar to the ink ejection amount Qh described above, the third volume V3 is calculated based on print data included in a print command. Note that the third volume V3 may be calculated based on an amount of the ink ejected through the nozzles 29 of the recording head 21 during the printing processes.

Further, in the expression (6), a period of time t1 denotes a period of time (second(s)) that has elapsed since the printing process for the first sheet 12 has started until the liquid-level sensor 55 detects that the level of the ink in the storage chamber 121 becomes to the prescribed position P1. A fourth volume V4 denotes an amount of the ink supplied per unit time (second(s)) from the storage chamber 32 of the ink cartridge 30 to the storage chamber 121 of the tank 103. The fourth volume V4 is calculated using the expression (7). In the expression (7), g denotes gravitational acceleration.

As described above, the ink ejection amounts Qs and Qc are set such that the ink ejection amount Qs becomes greater than the ink ejection amount Qc. Accordingly, as the ink is supplied from the storage chamber 32 of the ink cartridge 30 and the storage chamber 121 of the tank 103 to the recording head 21, the level of the ink stored in the storage chamber 121 is lowered to a position below the level of the ink stored in the storage chamber 32. Thereafter, however, the ink in the storage chamber 32 flows into the storage chamber 121 due to hydraulic head difference, and therefore the level of the ink stored in the storage chamber 121 and the level of the ink stored in the storage chamber 32 in the up-down direction 7 become identical to each other.

A value of t1·V4 in the expression (6) is indicative of an amount of the ink flowing due to hydraulic head difference from the storage chamber 32 to the storage chamber 121 since the printing process for the first sheet 12 has started in response to input of the print command until the liquid-level sensor 55 detects that the level of the ink in the storage chamber 121 becomes to the prescribed position P1.

The expression (7) includes the lengths Hc and Hs respectively calculated based on the ink amounts Vc and Vs. The third volume V3 denotes an amount of the consumed ink as described above. That is, in S100 the controller 130 calculates the first volume V1 based on the ink amounts Vc and Vs and an amount of the ink consumed in the printing process for the sheets 12 calculated on a basis of a print command.

Next, calculation method by the controller 130 of the second volume V2 will be described in detail. The second volume V2 denotes an amount of the ink consumed by the recording head 21 since the liquid-level sensor 55 has performed the detection until the printing process has been completed (S90: YES) during the printing process performed in response to the print command inputted to the controller 130 in S10. In other words, the second volume V2 denotes an amount of the ink supplied from both the storage chamber 121 of the tank 103 and the storage chamber 32 of the ink cartridge 30 to the recording head 21 since the liquid-level sensor 55 detects that the level of the ink in the storage chamber 121 has lowered to the prescribed position P1 until completion of the printing process in the printing process in accordance with the print command.

For example, when a print command to execute printing processes for ten sheets 12 is inputted to the controller 130, and when the liquid-level sensor 55 detects that the ink in the storage chamber 121 becomes equal to or lower than the prescribed position P1 while the printing process for the eighth sheet 12 is executed, the second volume V2 denotes an amount of the ink supplied from the storage chamber 32 and the storage chamber 121 to the recording head 21 since the liquid-level sensor 55 detects that the level of the ink in the storage chamber 121 becomes to the prescribed position P1 while the printing process for the eighth sheet 12 is executed until the printing process for the tenth sheet 12 has been completed. Similar to the ink ejection amount Qh described above, the second volume V2 is calculated based on print data included in a print command. The second volume V2 is an example of a second volume.

Subsequent to the process in S100, in S110 the controller 130 determines whether the second volume V2 calculated in S100 is equal to or greater than the threshold amount Vth. When the second volume V2 is smaller than the threshold amount Vth (S110: NO), in S120 the controller 130 continues to perform the printing process for the sheet 12.

On the other hand, when the second volume V2 is equal to or greater than the threshold amount Vth (S110: YES), in S130 the controller 130 determines whether a prescribed period of time T has elapsed. When the prescribed period of time T has not yet elapsed (S130: NO), the controller 130 waits until the prescribed period of time T has elapsed. When the controller 130 determines that the prescribed period of time T has elapsed (S130: YES), the controller 130 advances to the process in S120, i.e., continues to perform the printing process for the sheet 12.

The prescribed period of time T is a preset period of time enough to allow the ink stored in the storage chamber 32 above the level of the ink in the storage chamber 121 to flow into the storage chamber 121 due to the hydraulic head difference so that the ink in the storage chamber 32 and the level of the ink in the storage chamber 121 to become equal to each other.

In S140 the controller 130 determines whether or not the printing process for the sheet 12 continued in S120 has been completed. When the printing process for the sheet 12 has not yet been completed (S140: NO), the controller 130 returns to S120 and controls the recording portion 24 to continue the printing process for the sheet 12. When the controller 130 determines that the printing process for the sheet 12 has been completed (S140: YES), subsequently in S150 the controller 130 determines whether the second volume V2 calculated in S100 is greater than the first volume V1.

When the second volume V2 is greater than the first volume V1, i.e., an amount of the ink consumed by the recording head 21 after the liquid-level sensor 55 detects reduction of the ink in the storage chamber 121 is greater than the first volume V1 (S150: YES), the controller 130 notifies the user that the ink stored in the storage chamber 32 of the ink cartridge 30 can be no longer supplied to the storage chamber 121 of the tank 103.

As an example of the notification method, in S160 the controller 130 controls the display 20 to perform notification. Specifically, the controller 130 controls the display 20 to display thereon a message indicating that the remaining amount of ink in the storage chamber 32 has been decreased and the ink cannot be supplied to the storage chamber 121. However, the component or method other than the display 20 may be employed as an example of a notifying portion that performs notification. For example, a speaker, a light emitting diode (LED) lamp, or a combination thereof can be employed. Alternatively, a communication interface including a communication IC may be used as the notifying portion. In this case, the controller 130 controls the communication interface to issue a notification to external devices such as a personal computer (PC), a tablet device and the like. Accordingly, the communication interface can perform the notification through the external devices. After executing the process in S120, the controller 130 executes the processes in S70 and subsequent thereto.

Note that the controller 130 may perform notification in S160 to notify the user of the circumstances other than the circumstance described above. For example, in a case where the liquid-level sensor 55 is provided such that the prescribed position P1 is higher than the ink needle 102, the controller 130 may notify the user that the time for replacement of the ink cartridge 30 with a new ink cartridge 30 is approaching.

On the other hand, when the second volume V2 calculated in S100 is equal to or smaller than the first volume V1 (S150: NO), the controller 130 does not perform the notification in S160 described above and proceeds to the processes in S70 and subsequent thereto.

Operational and Technical Advantages in First Embodiment

At a timing when the liquid-level sensor 55 detects that the level of the ink stored in the storage chamber 121 of tank 103 becomes equal to the prescribed position P1, there is a possibility that the level of the ink stored in the storage chamber 32 of the ink cartridge 30 is higher than the prescribed position P1. In the above case, if the controller 130 controls the display 20 to notify the user that the ink is no longer supplied from the storage chamber 32 to the storage chamber 121 based on the detection result by the liquid-level sensor 55, the performed notification is an erroneous notification.

According to the present embodiment, the controller 130 does not control the display 20 to perform the notification at a timing when the liquid-level sensor 55 detects that the level of the ink in the storage chamber 121 has lowered to the prescribed position P1 (S50: YES). Instead, after the detection by the liquid-level sensor 55, on the condition that the controller 130 determines that the ink stored in the storage chamber 32 in a region above the prescribed position P1 has been consumed (S150: YES), in S160 the controller 130 controls the display 20 to perform the notification, thereby enabling decrease of a possibility that such an erroneous notification described above is performed.

In the expression (6) indicated above, an amount of the ink supplied from the storage chamber 32 of the ink cartridge 30 to the storage chamber 121 of the tank 103 in the printing process for the sheet 12 is taken into consideration. Accordingly, precision of the first volume V1 calculated in S100 can be increased.

When the second volume V2 is equal to or greater than the threshold amount Vth, there is a possibility that the level of the ink stored in the storage chamber 121 of the tank 103 becomes lower than the upper end of the outlet port 128 during the execution of the printing process. In this case, the air may flow out through the outlet port 128.

According to the present embodiment, when the second volume V2 is equal to or greater than the threshold amount Vth (S110: YES), the controller 130 controls the recording portion 24 to stop the printing process for the sheet 12 for the prescribed period of time T (S130: NO). During this prescribed period of time T, hydraulic head difference between the storage chamber 32 and the storage chamber 121 causes the ink in the storage chamber 32 to be supplied to the storage chamber 121, thereby retaining the level of the ink in the storage chamber 121 at a position above the upper end of the outlet port 128. Accordingly, this configuration allows decrease of a possibility that the air flows out of the storage chamber 121 through the outlet port 128.

Modifications

In the first embodiment described above, when the second volume V2 is equal to or greater than the threshold amount Vth (S110: YES), in S120 the controller 130 stops the printing process for the prescribed period of time T, and then controls the recording portion 24 to resume the printing process after the prescribed period of time T has elapsed (S130: YES). However, instead of stopping the printing process until the prescribed period of time T has elapsed in S130, or in addition to stopping the printing process until the prescribed period of time T has elapsed in S130, the controller 130 may perform a printing process for the sheet 12 in S120 at a speed slower than usual.

For example, during execution of the printing process for the sheet 12, the following methods may be employed: extending, longer than usual, a period of time since the conveying roller pair 25 stops conveyance of the sheet 12 until the carriage 22 starts moving; extending, longer than usual, a period of time since the carriage 22 stops moving until the conveying roller pair 25 resumes conveyance of the sheet 12; and controlling the conveying roller pair 25 to convey the sheet 12 at a speed slower than usual. With the above methods, the printing process for the sheet 12 in S120 can be executed at a speed slower than in usual.

When the second volume V2 is equal to or greater than the threshold amount Vth, the level of the ink stored in the storage chamber 121 of the tank 103 may become lower than the upper end of the outlet port 128. In this case, it is likely that the air flows out through the outlet port 128.

According to the above modification, when the second volume V2 is equal to or greater than the threshold amount Vth, the controller 130 decelerates a speed for executing a printing process for the sheet 12. While the speed for executing the printing process is decelerated, an amount of the ink to be consumed per unit time becomes reduced. Meanwhile, the ink is supplied from the storage chamber 32 of the ink cartridge 30 to the storage chamber 121 of the tank 103 due to hydraulic head difference. Accordingly, a possibility that the air from flowing out through the outlet port 128 can be reduced.

In the first embodiment described above, when the second volume V2 is greater than the first volume V1 (S150: YES), in S160 the controller 130 controls the display 20 to notify the user that the ink stored in the storage chamber 32 of the ink cartridge 30 can be no longer supplied to the storage chamber 121 of the tank 103. However, the controller 130 may control the display 20 and the like to perform the notification when a prescribed condition other than the condition described above is satisfied.

Figure 9B:
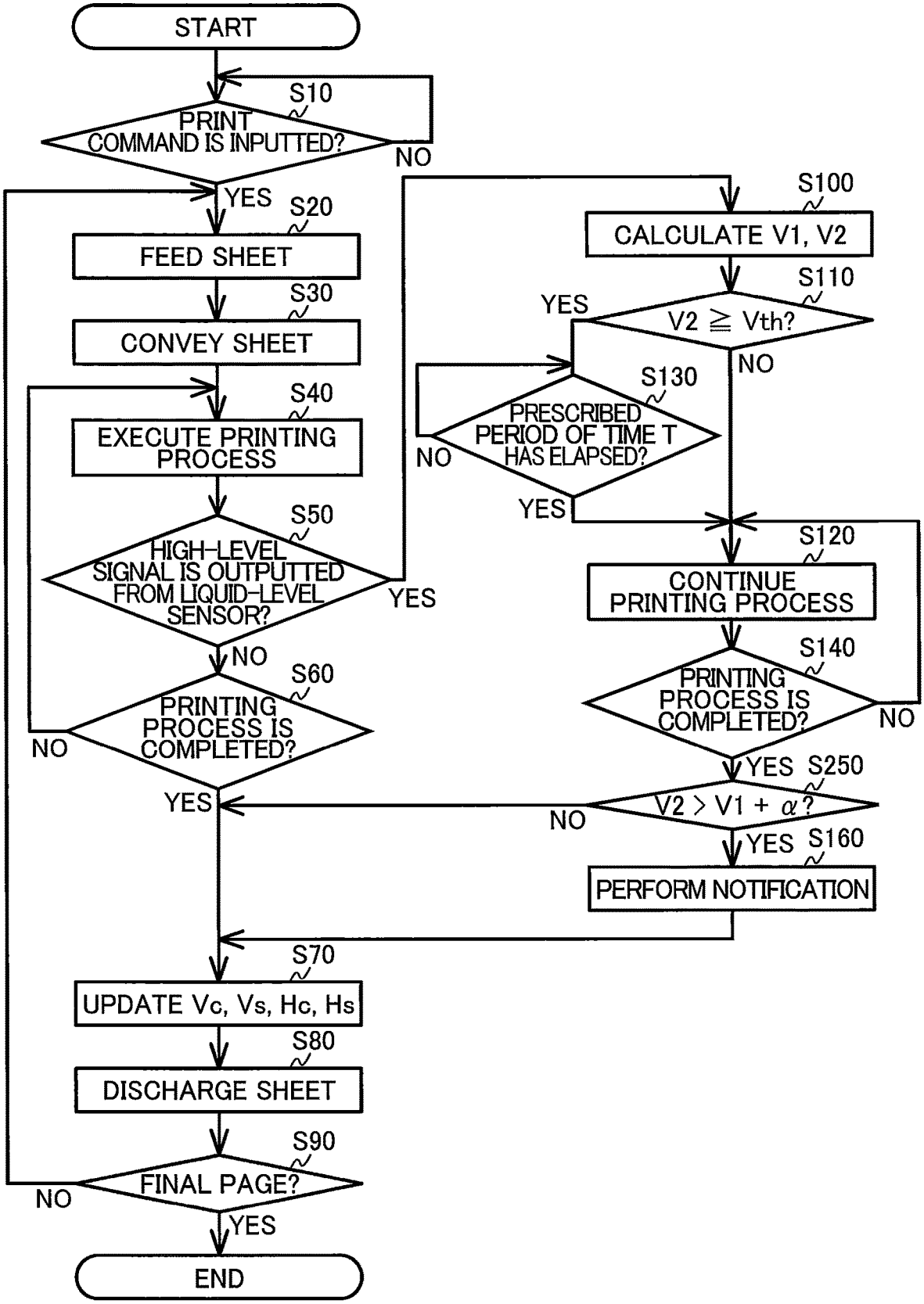
FIG. 9B is a flowchart illustrating steps in a print control process executed by a controller 130 of a multifunction peripheral 10 according to a modification to the first embodiment.

For example, the controller 130 may perform the processes illustrated in the flowchart of FIG. 9B. In, the flowchart in FIG. 9B, the controller 130 executes the process in S250 instead of the process in S150 in FIG. 9A. When the printing process for the sheet 12 has been completed (S140: YES), in S250 the controller 130 determines whether the second volume V2 is greater than an amount of the ink obtained by adding a prescribed amount α to the first volume V1. Then, when the second volume V2 is greater than the amount of the ink obtained by adding the prescribed amount a to the first volume V1 (S250: YES), in S160 the controller 130 controls the display 20 to perform the notification described above. The prescribed amount a is preset to, for example, an amount equivalent to ¼ (one-fourth) of the first volume V1. The prescribed amount a may be stored in the memory 153 of the circuit board 151 of the ink cartridge 30 or the RAM 133 of the controller 130 of the multifunction peripheral 10, for example.

As described above, since the second volume V2 is calculated and determined by the controller 130, the calculated second volume V2 may have a margin of error compared to an amount of the ink actually consumed by the recording portion 24. According to the modification described above, the display 20 performs the notification provided that the second volume V2 becomes greater than a total amount of the first volume V1 and the prescribed amount α. With the above configuration, even when the second volume V2 differs from an amount of the ink actually consumed by the recording portion 24, a possibility that the display 20 performs the erroneous notification can be decreased.

In the first embodiment described above, the controller 130 calculates the first volume V1 based on the expression (6) and the expression (7). However, the first volume V1 may be calculated based on expressions other than the expression (6) and the expression (7).

For example, the controller 130 may calculate the first volume V1 by subtracting an ink amount Vp1 from the ink amount Vc stored in the EEPROM at a timing when the liquid-level sensor 55 performs the detection. The ink amount Vp1 denotes an amount of the ink stored in the storage chamber 121 when the level of the ink in the storage chamber 121 is at the prescribed position P1. The ink amount Vp1 is a preset amount of ink and stored in the ROM 132 or the EEPROM 134.

In the embodiment described above, the controller 130 controls the display 20 to perform the notification after completion of the printing process for the sheet 12 (S140: YES) and before the sheet 12 is discharged onto the discharge tray 16 (S80). However, the notification may be performed at a timing different from the timing described above. For example, the notification may be performed after the sheet 12 has been discharged.

Alternatively, the controller 130 may perform the notification provided that a prescribed amount of ink is consumed after the controller 130 determines that the second volume V2 is greater than the first volume V1. In this case, it is likely that the controller 130 perform the notification when executing a printing process onto a sheet 12 to be printed after the sheet 12 that has been printed at a time when the second volume V2 is determined to be greater than the first volume V1. Note that the above prescribed amount denotes an amount to be compared with an amount obtained by cumulatively adding the ink ejection amount Qh described above, and is set to an amount equivalent to the threshold amount Vth described above, for example.

In the embodiment described above, the third volume V3 indicated in the expression (6) denotes an amount of the ink consumed by the recording head 21 since a printing process has started in response to input of a print command to the controller 130 in S10 until the liquid-level sensor 55 detects that the level of the ink in the storage chamber 121 becomes equal to or lower than the prescribed position P1. Further, the period of time t1 in the expression (6) denotes a period of time that has elapsed since the printing process described above has started until the liquid-level sensor 55 performs the detection described above. The second volume V2 denotes an amount of the ink the recording head 21 has consumed since the liquid-level sensor 55 performs the notification until the printing process in accordance with the print command has been completed.

However, the third volume V3, the period of time t1, and the second volume V2 are not limited to the amounts and the period of time employed in the embodiment described above. For example, the third volume V3 may be an amount of ink consumed by the recording head 21 since a printing process to one sheet 12 has started until the liquid-level sensor 55 has performed the detection during execution of the printing process onto the one sheet 12. The period of time t1 may be a period of time that has elapsed since a printing process to one sheet 12 has started until the liquid-level sensor 55 has performed the detection during execution of the printing process onto the one sheet 12.

Further, the second volume V2 may be an amount of the ink consumed by the recording head 21 since the liquid-level sensor 55 has performed the detection during execution of a printing process onto one sheet 12 until the printing process for the one sheet 12 has been completed. That is, the first volume V1 and the second volume V2 those are calculated based on the third volume V3 and the period of time t1 may be amounts to be calculated per each of the sheets 12.

Further, in the embodiment described above, the controller 130 updates the ink amount Vc, the ink amount Vs, the length Hc, and the length Hs in S70 each time a printing process onto one sheet 12 has been completed, i.e., per each of the sheets 12. However, the updating of the above values may be performed at a timing different from that in the above embodiment. For example, the controller 130 may update the above values per one pass, or each time a print command is inputted to the controller 130. In the latter case, when a print command that instructs to execute printing processes for ten sheets 12 has been inputted to the controller 130, the controller 130 updates the values after the printing process for the tenth sheet 12 has been completed.

In the embodiment described above, ink serves as an example of liquid. However, the present disclosure may also be embodied, for example, as a device with a roller for applying a pretreatment liquid onto a recording sheet prior to ink during a printing process. In this device, the pretreatment liquid may serve as the liquid.

Second Embodiment

Next, a second embodiment of the present disclosure will be described with reference to FIGS. 11 through 12B, wherein like parts and components are designated with the same reference numerals as shown in the first embodiment to avoid duplicating description. A multifunction peripheral 10 according to the second embodiment includes an ink cartridge 230 as another example of the cartridge and a tank 203.

In the first embodiment described above, the resistance values Rs, Rc, and Rn are set such that these values satisfy the inequality Rn+Rc>Rs. Further, each of the liquid-level sensors 55 is configured to detect whether the level of the ink stored in the storage chamber 121 of the corresponding tank 103 becomes equal to or lower than the prescribed position P1. However, in the second embodiment, the resistance values Rs, Rc, and Rn are set to satisfy an inequality Rn+Rc<Rs, and each of the liquid-level sensor is configured to detect whether the level of the ink stored in the storage chamber 32 of the corresponding ink cartridge 230 becomes equal to or lower than a prescribed position P3.

Figure 12A:
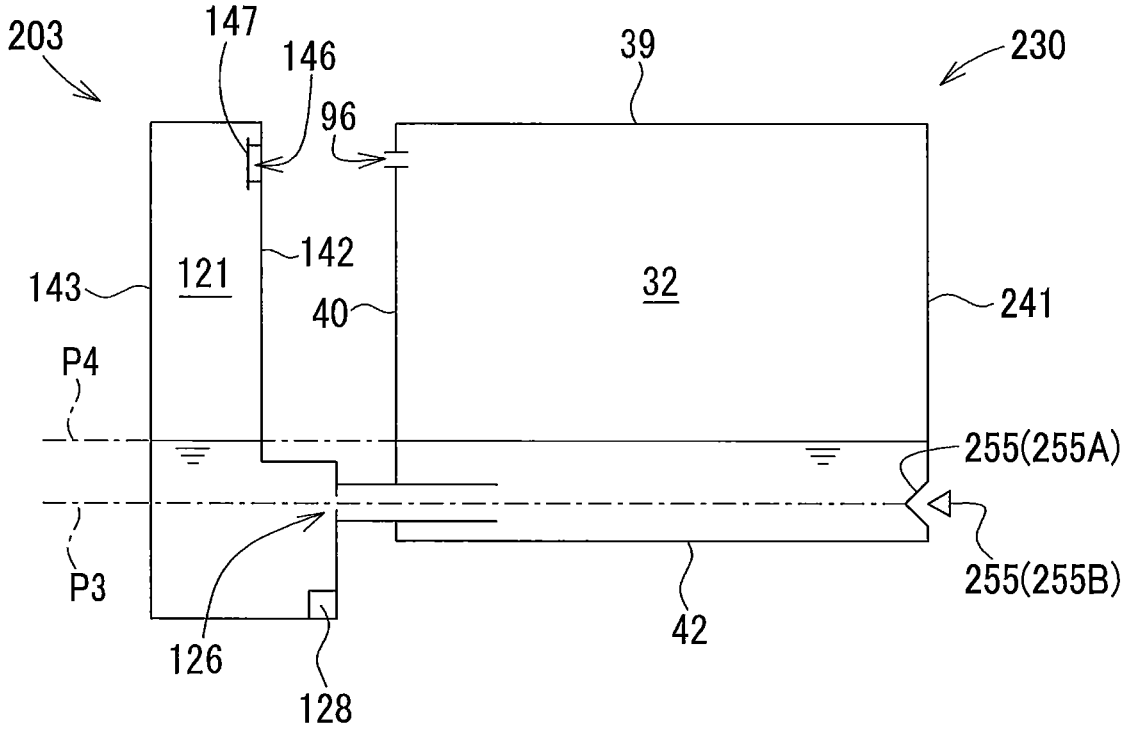
FIG. 12A is a schematic diagram illustrating a tank 203 and an ink cartridge 230 of a multifunction peripheral according to a second embodiment of the present disclosure, and illustrating a state where the tank 203 and the ink cartridge 230 are connected to each other and a level of ink stored in the tank 203 is the same as a level of ink stored in the ink cartridge 230.

Each of the ink cartridges 230 according to the second embodiment includes a liquid-level sensor 255 including a prism 255A, a light-emitting portion 255B, and a light-receiving portion (not illustrated). The liquid-level sensor 255 is another example of the detecting portion. Of a front wall 241 of the ink cartridge 230 that defines the storage chamber 32, a portion adjacent to the prescribed position P3 serves as the prism 255A, as illustrated in FIGS. 12A and 12B. The light-emitting portion 255B and the light-receiving portion are disposed to the front of the prism 255A and face the prism 255A. With this configuration, the liquid-level sensor 255 can detect whether the level of the ink stored in the storage chamber 32 of the ink cartridges 230 becomes equal to or lower than the prescribed position P3.

Figure 11:
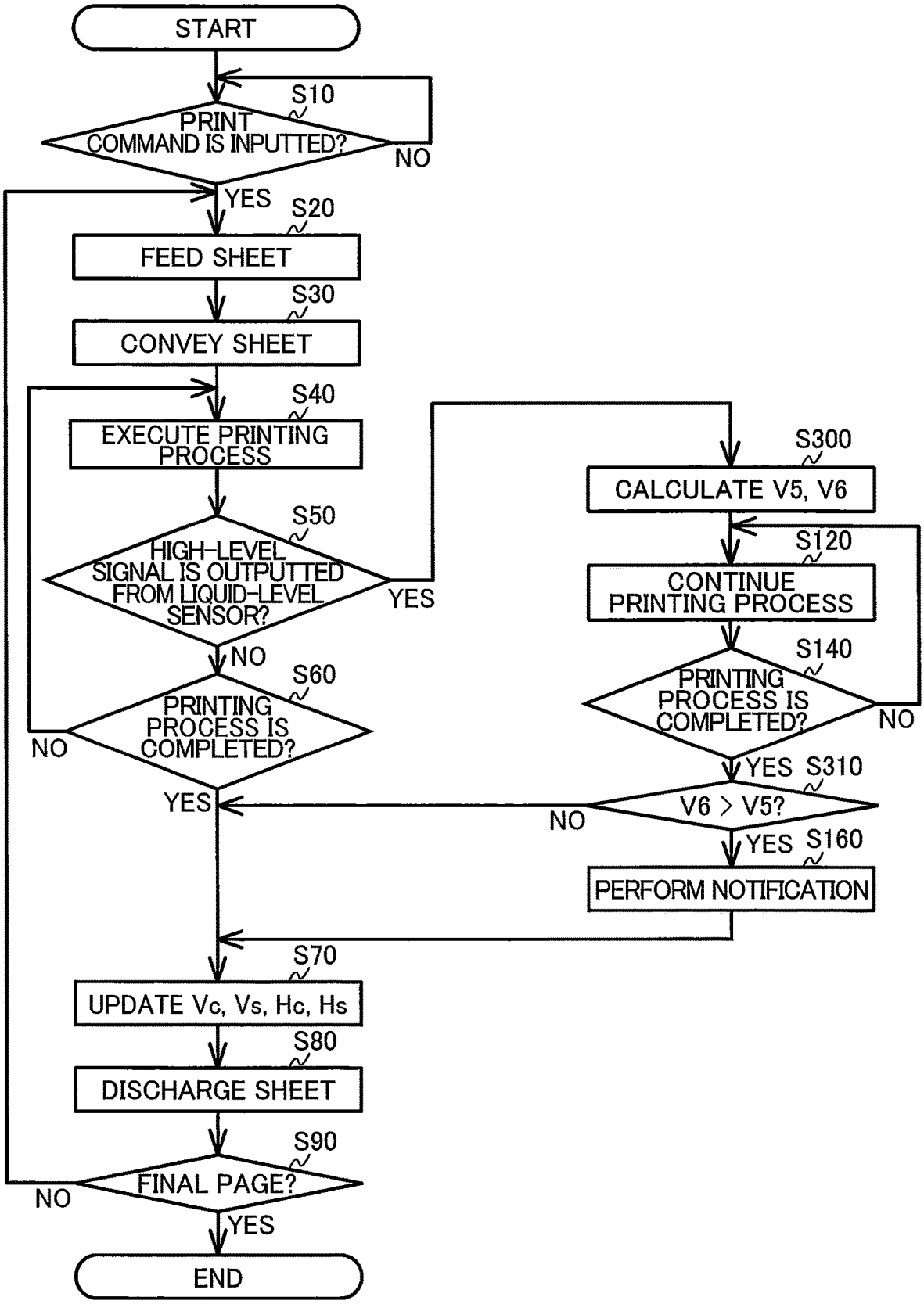
FIG. 11 is a flowchart illustrating steps in a print control process executed by a controller 130 of a multifunction peripheral according to the second embodiment.

FIG. 11 is a flowchart illustrating steps in a printing control process executed by a controller 130 according to the second embodiment. The flowchart in FIG. 11 is generally identical to the flowchart in FIG. 9A used in the first embodiment. Accordingly, in the description as to the flowchart in FIG. 11, processes that differ from the processes in the flowchart in FIG. 9A will be described, while omitting description as to the processes the same as those in the flowchart in FIG. 9A.

In the following description, in an initial state when the controller 130 executes the printing control process, the level of the ink stored in the storage chamber 32 of the ink cartridge 230 and the level of the ink stored in the storage chamber 121 of the tank 203 are assumed to be aligned with each other at a position P4 that is higher than the liquid-level sensor 255, as illustrated in FIG. 12A.

In the flowchart in FIG. 11, the processes in S100 and S150 of the flowchart in FIG. 9A are replaced with processes in S300 and S310, respectively. Further, in the flowchart in FIG. 11, the processes in S110 and S130 of the flowchart in FIG. 9A are not executed.

In S300, the controller 130 calculates a fifth volume V5 and a sixth volume V6.

Calculation method of the fifth volume V5 by the controller 130 will be described in detail. As described above, the resistance values Rs, Rc and Rn are set to satisfy the inequality Rn+Rc<Rs in the second embodiment. Accordingly, different from the first embodiment described above, the ink ejection amount Qc becomes greater than the ink ejection amount Qs. That is, at a time when the liquid-level sensor 255 detects that the level of the ink stored in the storage chamber 32 has lowered to the prescribed position P3, the level of the ink stored in the storage chamber 32 is lower than the level of the ink stored in the storage chamber 121. At this time, an amount of the ink stored in the storage chamber 121 at a region above the level of the ink stored in the storage chamber 32 is the fifth volume V5. The fifth volume V5 is another example of the first volume.

Figure 12B:
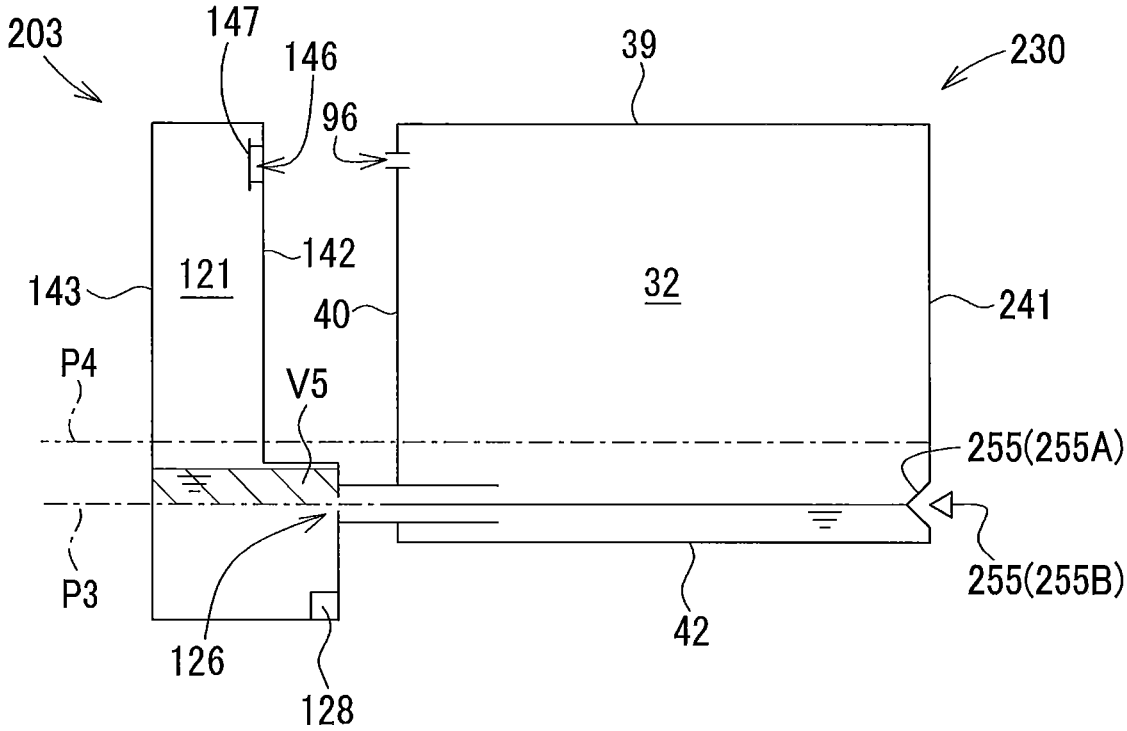
FIG. 12B is a schematic diagram illustrating the tank 203 and the ink cartridge 230 of the multifunction peripheral according to the second embodiment, and illustrating a state where the tank 203 and the ink cartridge 230 are connected to each other and the level of ink stored in the tank 203 differs from the level of ink stored in the ink cartridge 230.

FIG. 12B illustrates the level of the ink stored in the storage chamber 32 of the ink cartridge 230 and the level of the ink stored in the storage chamber 121 of the tank 203 at the time when the liquid-level sensor 255 detects that the level of the ink in the storage chamber 32 becomes equal to or lower than the prescribed position P3. The fifth volume V5 in the second embodiment corresponds to an ink amount indicated by a hatching area in FIG. 12B. Similar to the first volume V1 in the first embodiment described above, the fifth volume V5 can be calculated based on the expression (6) and the expression (7).

The sixth volume V6 is similar to the second volume V2 in the first embodiment. The sixth volume V6 is calculated in a similar manner to the second volume V2. The sixth volume V6 is another example of the second volume.

Note that the ink amounts and the ink ejection amounts other than the fifth volume V5 and the sixth volume V6 in the second embodiment can be calculated in a manner the same as the first embodiment described above.

In S310, the controller 130 compares the fifth volume V5 with the sixth volume V6 calculated in S300 and determines whether the sixth volume V6 is greater than the fifth volume V5. When the sixth volume V6 is greater than the fifth volume V5, i.e., when an amount of the ink consumed by the recording head 21 since the liquid-level sensor 255 detects that the level of the ink in the storage chamber 32 has lowered to the prescribed position P3 until the printing process to all of the sheets 12 in response to the inputted print command has been completed is greater than the fifth volume V5 (S310: YES), in S160 the controller 130 controls the display 20 to notify the user that the ink stored in the storage chamber 32 of the ink cartridge 30 can be no longer supplied to the storage chamber 121 of the tank 103, for example. Thereafter, the controller 130 executes the processes in S70 and subsequent thereto as in the first embodiment.

On the other hand, when the sixth volume V6 calculated in S300 is equal to or smaller the fifth volume V5 (S310: NO), the controller 130 proceeds to the process S70 and the processes subsequent thereto without controlling the display 20 to perform the notification in S160.

The modifications to the first embodiment can be also applied to the second embodiment.

When the level of the ink stored in the storage chamber 32 of the ink cartridge 230 has lowered to the prescribed position P3, there is a possibility that the level of the ink stored in the storage chamber 121 of the tank 203 is higher than the prescribed position P3. In a case where the controller 130 controls the display 20 to notify the user that the ink cannot be supplied from the storage chamber 32 to the storage chamber 121 based on the detection result by the liquid-level sensor 255 despite that the level of the ink stored in the storage chamber 121 is higher than the prescribed position P3, the performed notification is an erroneous notification.

This is because, after the liquid-level sensor 255 detects that the level of the ink stored in the storage chamber 32 becomes equal to or lower than the prescribed position P3, the ink stored in the storage chamber 121 of the tank 203 flows back to the storage chamber 32 of the ink cartridge 230 due to hydraulic head difference between the storage chamber 121 and the storage chamber 32, thereby allowing the level of the ink in the storage chamber 32 to become higher than the prescribed position P3.

According to the second embodiment, the controller 130 does not cause the display 20 to perform the notification when the controller 130 determines through the liquid-level sensor 255 that the level of the ink in the storage chamber 32 becomes equal to or lower than the prescribed position P3. Instead, the controller 130 causes the display 20 to perform the notification on the condition that the ink stored in the storage chamber 121 above the prescribed position P3 has been consumed after the determination. Accordingly, this configuration can prevent erroneous notification described above.

While the description has been made in detail with reference to the embodiment(s) thereof, it would be apparent to those skilled in the art that many modifications and variations may be made therein without departing from the spirit of the disclosure.

What is claimed is:

1. A liquid ejection apparatus comprising:

a cartridge comprising:

a first storage chamber configured to store liquid therein; and a first air communicating portion allowing the first storage chamber to communicate with an atmosphere;

a tank to which the cartridge is connectable, the tank comprising:

a second storage chamber configured to store the liquid therein;

an inlet port through which the liquid stored in the first storage chamber of the cartridge connected to the tank is introduced into the second storage chamber;

an outlet port through which the liquid stored in the second storage chamber flows out; and a second air communicating portion allowing the second storage chamber to communicate with the atmosphere;

at least one nozzle configured to eject the liquid flowing out from the second storage chamber through the outlet port;

a detecting portion configured to detect whether a level of the liquid stored in the second storage chamber becomes equal to or lower than a prescribed position;

a memory storing therein a first liquid amount and a second liquid amount, the first liquid amount being an amount of the liquid stored in the first storage chamber, the second liquid amount being an amount of the liquid stored in the second storage chamber;

a notifying portion; and a controller configured to perform:

in response to receiving a command to consume the liquid, (a) controlling the at least one nozzle to eject the liquid at a speed;

(b) determining, while performing the (a) controlling, whether the detecting portion detects that the level of the liquid stored in the second storage chamber becomes equal to or lower than the prescribed position;

in response to the (b) determining determining that the detecting portion detects that the level of the liquid stored in the second storage chamber becomes equal to or lower than the prescribed position, (c) calculating a first volume and a second volume, the first volume being an amount of the liquid stored in the first storage chamber above the level of the second storage chamber at a time when the detecting portion detects that the level of the liquid stored in the second storage chamber becomes equal to or lower than the prescribed position, the first volume being calculated based on the first liquid amount, the second liquid amount, and a third volume, the third volume being an amount of the liquid ejected by the at least one nozzle since start of the (a) controlling until the detecting portion detects that the level of the liquid stored in the second storage chamber becomes equal to or lower than the prescribed position, the second volume being an amount of the liquid ejected by the at least one nozzle since the detecting portion detects that the level of the liquid stored in the second storage chamber becomes equal to or lower than the prescribed position until completion of the (a) controlling;

(d) determining whether the second volume is greater than the first volume; and in response to the (d) determining determining that the second volume is greater than the first volume, (e) controlling the notifying portion to notify that the level of the liquid stored in the second storage chamber becomes equal to or lower than the prescribed position.

2. The liquid ejection apparatus according to claim 1, wherein the memory further stores therein a prescribed amount, wherein the (d) determining determines whether the second volume is greater than an amount of the liquid obtained by adding the prescribed amount stored in the memory to the first volume, and wherein, in response to the (d) determining determining that the second volume is greater than the amount of the liquid obtained by adding the prescribed amount to the first volume, the controller is configured to perform the (e) controlling.

3. The liquid ejection apparatus according to claim 1, wherein the (c) calculating calculates the first volume based on following expressions (1) and (2):

$$V1=V3-t1\cdot V4 \quad (1); \text{ and}$$

$$V4=(\rho\cdot g\cdot(Hc-Hs))/(Rc+Rs+Rn) \quad (2),$$

in which:

V1: the first volume;

V3: the third volume;

t1: a period of time that has elapsed since the start of the (a) controlling until the detecting portion detects that the level of the liquid stored in the second storage chamber becomes equal to or lower than the prescribed position;

V4: an amount of the liquid supplied from the first storage chamber to the second storage chamber per unit time;

ρ: viscosity of the liquid;

g: gravitational acceleration;

Hc: a length in an up-down direction between a level of the liquid stored in the first storage chamber and the prescribed position;

Hs: a length in the up-down direction between the level of the liquid stored in the second storage chamber and the prescribed position;

Rc: a resistance imposed upon an air passing through the first air communicating portion;

Rs: a resistance imposed upon an air passing through the second air communicating portion; and Rn: a resistance imposed upon the liquid flowing from the first storage chamber into the second storage chamber.

4. The liquid ejection system according to claim 1, wherein the memory further stores therein a threshold amount, and wherein the controller is configured to further perform:

(f) determining whether the second volume is greater than the threshold amount stored in the memory, and wherein, in response to the (f) determining determining that the second volume is greater than the threshold amount stored in the memory, the (a) controlling controls the at least one nozzle to stop ejection of the liquid for a prescribed period of time.

5. The liquid ejection apparatus according to claim 1, wherein the memory further stores therein a threshold amount, wherein the controller is configured to further perform:

(g) determining whether the second volume is greater than the threshold amount stored in the memory, and wherein, in response to the (g) determining determining that the second volume is greater than the threshold amount stored in the memory, the (a) controlling controls the at least one nozzle to eject the liquid at a speed slower than usual.

6. A liquid ejection apparatus comprising:

a cartridge comprising:

a first storage chamber configured to store liquid therein; and a first air communicating portion allowing the first storage chamber to communicate with an atmosphere;

a tank to which the cartridge is connectable, the tank comprising:

a second storage chamber configured to store the liquid therein;

an inlet port through which the liquid stored in the first storage chamber of the cartridge connected to the tank is introduced into the second storage chamber;

an outlet port through which the liquid stored in the second storage chamber flows out; and a second air communicating portion allowing the second storage chamber to communicate with the atmosphere;

at least one nozzle configured to eject the liquid flowing out from the second storage chamber through the outlet port;

a detecting portion configured to detect whether a level of the liquid stored in the first storage chamber becomes equal to or lower than a prescribed position;

a memory storing therein a first liquid amount and a second liquid amount, the first liquid amount being an amount of the liquid stored in the first storage chamber, the second liquid amount being an amount of the liquid stored in the second storage chamber;

a notifying portion; and a controller configured to perform:

in response to receiving a command to consume the liquid, (a) controlling the at least one nozzle to eject the liquid at a speed;

(b) determining, while performing the (a) controlling, whether the detecting portion detects that the level of the liquid stored in the first storage chamber becomes equal to or lower than the prescribed position;

in response to the (b) determining determining that the detecting portion detects that the level of the liquid stored in the first storage chamber becomes equal to or lower than the prescribed position, (c) calculating a first volume and a second volume, the first volume being an amount of the liquid stored in the second storage chamber above the level of the first storage chamber at a time when the detecting portion detects that the level of the liquid stored in the first storage chamber becomes equal to or lower than the prescribed position, the first volume being calculated based on the first liquid amount, the second liquid amount, and a third volume, the third volume being an amount of the liquid ejected by the at least one nozzle since start of the (a) controlling until the detecting portion detects that the level of the liquid stored in the first storage chamber becomes equal to or lower than the prescribed position, the second volume being an amount of the liquid ejected by the at least one nozzle since the detecting portion detects that the level of the liquid stored in the first storage chamber becomes equal to or lower than the prescribed position until completion of the (a) controlling;

(d) determining whether the second volume is greater than the first volume; and in response to the (d) determining determining that the second volume is greater than the first volume, (e) controlling the notifying portion to notify that the level of the liquid stored in the first storage chamber becomes equal to or lower than the prescribed position.

* * * * *